US008652730B2

(12) United States Patent
Akiyama et al.

(10) Patent No.: US 8,652,730 B2
(45) **Date of Patent: *Feb. 18, 2014**

(54) ELECTROSTATIC IMAGE DEVELOPING TONER, ELECTROSTATIC IMAGE DEVELOPER, PROCESS CARTRIDGE, IMAGE FORMING APPARATUS, AND IMAGE FORMING METHOD

(75) Inventors: Hitomi Akiyama, Tokyo (JP); Junichi Tomonaga, Kanagawa (JP)

(73) Assignee: Fuji Xerox Co., Ltd., Tokyo (JP)

( * ) Notice: Subject to any disclaimer, the term of this patent is extended or adjusted under 35 U.S.C. 154(b) by 82 days.

This patent is subject to a terminal disclaimer.

(21) Appl. No.: 13/090,706

(22) Filed: Apr. 20, 2011

(65) Prior Publication Data

US 2012/0115081 A1 May 10, 2012

(30) Foreign Application Priority Data

Nov. 5, 2010 (JP) ..... 2010-248061

(51) Int. Cl.
*G03G 9/00* (2006.01)

(52) U.S. Cl.
USPC ..... 430/109.4; 430/108.1; 430/109.1

(58) Field of Classification Search
USPC ..... 430/108.1, 108.4, 109.1, 109.4
See application file for complete search history.

(56) References Cited

U.S. PATENT DOCUMENTS

| | | | | |
|---|---|---|---|---|
| 6,001,524 | A * | 12/1999 | Yoon et al. | 430/109.4 |
| 6,517,985 | B2 * | 2/2003 | Takagi et al. | 430/45.54 |
| 2002/0115009 | A1 * | 8/2002 | Takagi et al. | 430/110.3 |
| 2010/0075240 | A1 * | 3/2010 | Akiyama et al. | 430/105 |
| 2010/0075241 | A1 | 3/2010 | Kazmaier et al. | |
| 2010/0261114 | A1 | 10/2010 | Akiyama et al. | |
| 2010/0261115 | A1 | 10/2010 | Tomonaga et al. | |
| 2012/0077118 | A1 * | 3/2012 | Tomonaga et al. | 430/105 |
| 2012/0115081 | A1 | 5/2012 | Akiyama et al. | |

FOREIGN PATENT DOCUMENTS

| | | |
|---|---|---|
| JP | A-56-011461 | 2/1981 |
| JP | A-62-039879 | 2/1987 |
| JP | B2-62-39428 | 8/1987 |
| JP | A-63-282752 | 11/1988 |
| JP | A-2008-70455 | 3/2008 |
| JP | A-2009-69647 | 4/2009 |
| JP | A-2009-122522 | 6/2009 |

OTHER PUBLICATIONS

Jan. 16, 2013 Office Action issued in U.S. Appl. No. 13/035,279.
U.S. Appl. No. 13/035,279 to Tomonaga et al., filed Feb. 25, 2011.
Apr. 25, 2013 Office Action issued in U.S. Appl. No. 13/035,279.

* cited by examiner

*Primary Examiner* — Stewart Fraser
(74) *Attorney, Agent, or Firm* — Oliff and Berridge, PLC

(57) ABSTRACT

An electrostatic image developing toner including: a toner particle containing a binder resin having a polyester resin and a coloring agent; and a non-colored particle containing a polyester but not containing a coloring agent and having a shape factor SF1 of not more than 110, wherein an amount of Sn element contained in the non-colored particles is larger than an amount of Sn element contained in the toner particle.

14 Claims, 2 Drawing Sheets

ELECTROSTATIC IMAGE DEVELOPING TONER, ELECTROSTATIC IMAGE DEVELOPER, PROCESS CARTRIDGE, IMAGE FORMING APPARATUS, AND IMAGE FORMING METHOD

CROSS-REFERENCE TO RELATED APPLICATION(S)

The present application claims priority from Japanese Patent Application No. 2010-248061 filed on Nov. 5, 2010, the entire content of which is incorporated herein by reference.

BACKGROUND

1. Field

The present invention relates to an electrostatic image developing toner, an electrostatic image developer, a process cartridge, an image forming apparatus and an image forming method.

2. Description of the Related Art

A method for visualizing image information through an electrostatic charge image, such as electrophotography, is recently utilized in various fields. In the electrophotography, for example, the visualization is performed by forming an electrostatic latent image on an image holding member by a charge and exposure step (electrostatic latent image forming step), developing the electrostatic latent image with an electrostatic image developer (hereinafter also referred to simply as a "developer") containing an electrostatic image developing toner (hereinafter also referred to simply as a "toner") (developing step) and going through a transfer step and a fixing step. The developer as used herein includes a two-component developer composed of a toner and a carrier and a one-component developer using a magnetic toner or a non-magnetic toner singly.

SUMMARY (1) An electrostatic image developing toner including: a toner particle containing a binder resin having a polyester resin and a coloring agent; and a non-colored particle containing a polyester but not containing a coloring agent and having a shape factor SF1 of not more than 110, wherein an amount of Sn element contained in the non-colored particles is larger than an amount of Sn element contained in the toner particle.

DETAILED DESCRIPTION OF EXEMPLARY EMBODIMENTS

Figure 1:
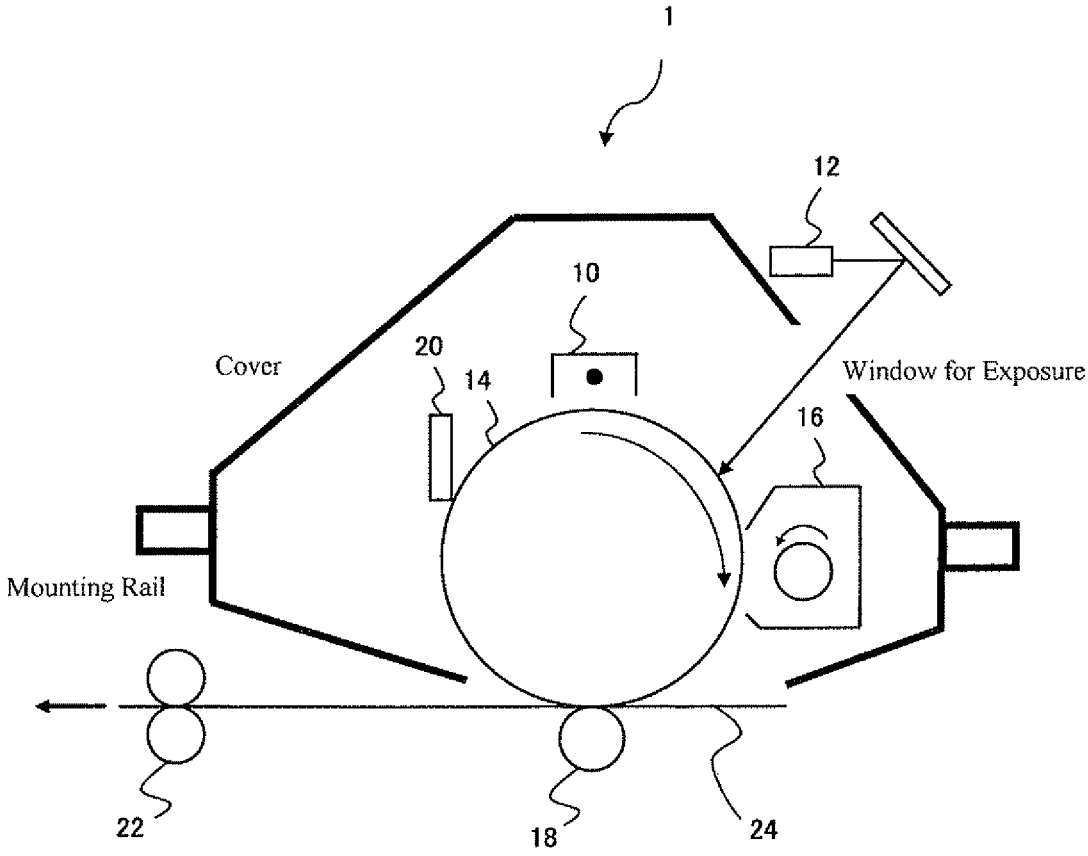
FIG. 1 is a diagrammatic configuration view showing an example of a process cartridge according to an exemplary embodiment of the invention.

Exemplary embodiments of the invention are hereinafter described. The present exemplary embodiments show merely an example for carrying out the invention, but it should not be construed that the invention is limited to the present exemplary embodiments.

<Electrostatic Image Developing Toner>

The toner according to an exemplary embodiment of the invention contains toner particles containing a polyester resin and a coloring agent; and non-colored particles containing a polyester but not containing a coloring agent and having a shape factor SF1 of not more than 110, wherein an amount of Sn element contained in the non-colored particles is larger than an amount of Sn element contained in the toner particles.

Here, more precisely, the "amount of Sn element" as referred to in this specification means a content caused by an ionic Sn element contained in a tin compound catalyst which is utilized for polymerization of the polyester resin, from which a component caused by a covalent Sn element, such as tin oxide, is excluded.

In recent years, in view of a cost reduction and the like in logistics, there may be the case where a movement at high temperatures for a long period of time is required, and electrostatic image developing toners are not exceptional, too. In the case of a toner, a fluidizing agent (sometimes referred to as an "external additive") is allowed to exist on its surface to suppress the contact of binder resins with each other among the toners, thereby controlling toner-to-toner aggregation properties. However, it is noted that when storage accompanied by a repeated temperature change under a high-temperature condition is performed, deterioration of the aggregation properties cannot be controlled. Though the reason for this is not always elucidated, the following may be assumed. That is, the fluidizing agent on the toner surface is in general high in hydrophobicity; and when the temperature increases in a state where the fluidizing agent is adhered, a change is caused in the arrangement of resin molecules, hydrophobilized molecules are arranged in a binder resin portion coming into contact with the fluidizing agent, and as a result, hydrophilicity of a portion not coming into contact with the fluidizing agent increases. When heat is repeatedly applied, the resin is cooled each time, and a minute volume change is repeated. As a result, the fluidizing agent is embedded into the inside of the toner, and at the same time, the hydrophilicity of the portion not coming into contact with the fluidizing agent increases. In addition, the binder resin constituting the toner has a width in the molecular weight to some extent, and in many cases, components having a small molecular weight have high hydrophilicity. For that reason, it may be considered that when the storage accompanied by a repeated temperature change is performed, the hydrophilicity of the resin on the toner surface increases, so that the aggregation properties are deteriorated.

The toner according to the present exemplary embodiment is excellent in storage stability under a specified heat condition, namely, storage stability under a heating condition for 24 hours in a continuous temperature change (1° C./min) between 40° C. and 55° C. in a state of storing a toner cartridge (namely, temperature increase and temperature decrease are repeated between 40° C. and 55° C.), because the amount of Sn element contained in the non-colored particles is larger than the amount of Sn element contained in the toner particles. At least the ionic Sn element is contained in the non-colored particles, and mechanical strength and heat resistance of the particles are enhanced with an increase of the content of the Sn element. It may be considered that this is caused due to the fact that the Sn element contributes to formation of ion crosslinking in a matrix of the toner particles or non-colored particles, so that the molecular weight and the glass transition temperature become relatively high. Then, it may be considered that since the amount of Sn element contained in the non-colored particles is larger than the Sn element content contained in the toner particles, the non-colored particles having relatively high mechanical strength and heat resistance exist in the toner particles, and a disintegrating effect of the non-colored particles against the toner particles is revealed, so that aggregation is hardly generated, the storage stability is excellent even under the foregoing heating condition, and the generation of color streaks is suppressed, thereby revealing a favorable image quality.

In this specification, the terms "the amount of Sn element contained in the non-colored particles is larger than the amount of Sn element contained in the toner particles" mean that the amount of Sn element contained in the non-colored particles as determined by the method described in the Examples as described later is larger than the amount of Sn element contained in the toner particles. For example, the amount of Sn element contained in the non-colored particles is preferably in the range of from 1.1 times to 4 times, and more preferably in the range of from 1.1 times to 3 times the amount of Sn element contained in the toner particles. When the amount of Sn element contained in the non-colored particles is less than 1.1 times the amount of Sn element contained in the toner particles, there may be the case where the effect for preventing the toner aggregation is not sufficiently exhibited. Meanwhile, when it exceeds 4 times, since the hardness of the non-colored particles increases, even when the non-colored particles are caught in a cleaning blade, they are in a state where they are caught as are without being deformed, so that there may be the case where color streaks are rather easily caused.

As described later, the toner according to the present exemplary embodiment is, for example, prepared through an aggregated particle forming step of forming aggregated particles in a raw material liquid dispersion in which a coloring agent liquid dispersion having a coloring agent dispersed in a solvent and optionally, a liquid dispersion having other toner-constituting material of every sort dispersed therein are mixed in a resin particle liquid dispersion having resin particles containing a polyester resin dispersed in a solvent utilizing the phase inversion method; and a fusing step of fusing the aggregated particles.

There may be the case where an ionic Sn element is contained in the resin particles containing the polyester resin. In general, the polyester resin is synthesized by means of a polycondensation reaction between an acid component and an alcohol component, and in many cases, a catalyst compound containing an Sn element (hereinafter sometimes referred to simply as a "tin-containing catalyst") is used as a catalyst in this polymerization. Accordingly, the ionic Sn element in the resin particles containing the polyester resin is usually derived from the tin-containing catalyst which is used at the time of polymerization of the polyester resin. The Sn element is contained in a toner obtained using such an ionic Sn element-containing resin particle liquid dispersion as a raw material.

Meanwhile, there may be the case where non-colored particles not containing a coloring agent, which are relatively analogous to the toner particles with respect to the particle diameter, are incorporated in the toner. In the polymerization of the polyester resin using the tin-containing catalyst as a catalyst, when monomers of unreacted alcohol component and alcohol component retain, of such residual components, the monomer of the acid component has a carboxylic acid as a functional group, has high polarity and has high hydrophilicity. When the ionic Sn element of the tin-containing catalyst which does not come into a resin structure in the polymerization process of the polyester resin forms a complex together with the residual acid component, the acid component containing a carboxylic acid adhered onto the resin particle surface reduces in a process of preparing an emulsified resin (latex) using this resin. As a result, it may be considered that the hydrophilicity is lowered, and a reduction of the surface area is suppressed, whereby resin particles whose particle diameter is relatively analogous to the toner particles (such resin particles will be hereinafter sometimes referred to simply as "resin coarse particles") are produced.

Also, it may be considered that in the synthesis of the polyester resin, when the tin-containing catalyst is used as a catalyst, the polymerization reaction proceeds while allowing the tin-containing catalyst to act as the starting point of the reaction; however, the tin-containing catalyst gathers and is unevenly distributed in a portion where a viscosity of the reaction system is relatively low, so that the reaction proceeds in the unevenly distributed portion while generating heat; therefore, the viscosity does not increase in that portion because of the heat generation, and the polymerization further proceeds; and as a result, the resin coarse particles having a relatively high molecular weight and a relative high glass transition temperature are produced. For example, it may be considered that when the tin-containing catalyst is added in the reaction system while being divided in at least two stages at the time of manufacturing the polyester resin, the uneven distribution of the tin-containing catalyst in the reaction system becomes more remarkable, and the resin coarse particles having a relatively high Sn content are easily produced.

When the aggregated particles are formed in the color agent liquid dispersion and optionally, other raw material liquid dispersion using the resin particle liquid dispersion containing such resin coarse particles, resin particles whose usual particle diameter is relatively small (for example, about 200 nm) undergo the Brownian movement to come into collision and repeat aggregation, and take the coloring agent and the like therein, thereby forming the toner particles. Meanwhile, it may be considered that since the resin coarse particles do not substantially undergo the Brownian movement, they do not take the coloring agent and the like therein but remain as non-colored particles not containing the coloring agent substantially in a state as they are, and these non-colored particles have relatively high molecular weight and glass transition temperature as described above.

In this way, it may be considered that in view of the fact that the Sn element-containing non-colored particles are contained in the toner, the amount of Sn element contained in the non-colored particles is larger than the amount of Sn element contained in the toner particles.

In the present exemplary embodiment, the method for making the amount of Sn element contained in the non-colored particles larger than the Sn amount contained in the toner particles is not limited to the foregoing method. For example, there are exemplified a method in which the non-colored particles and the toner particles are separately manufactured, the amount of the tin-containing catalyst at the manufacture of the polyester resin which is used in the respective manufacture is adjusted, thereby adjusting the amount of Sn element contained in each of the particles, and the non-colored particles and the toner particles are mixed; and a method in which after synthesis of the polyester which is used in the manufacture of the non-colored particles and before preparation of the resin particle liquid dispersion, the Sn element-containing compound and the polyester resin are mixed.

In this specification, what the non-colored particles do not contain a coloring agent means that the amount of the coloring agent contained in the non-colored particles as determined in the method described in the Examples as described later is not more than 50 ppm.

In the toner according to the present exemplary embodiment, an SF1 of the non-colored particles is not more than 110. This is because the particles are formed by means of phase inversion emulsion such that the surface area is small as far as possible.

In the toner according to the present exemplary embodiment, the number of the non-colored particles is preferably in the range of from 10 to 50, and more preferably in the range of from 10 to 30 based on 5,000 toner particles. When the number of the non-colored particles is less than 10 based on 5,000 toner particles, there may be the case where the effect for preventing the aggregation of toner particles is not sufficiently exhibited. Meanwhile, when it exceeds 50, the amount of the non-colored particle is large so that it tends to become difficult to achieve cleaning by a cleaning blade, and therefore, there may be the case where an image quality defect such as color deletion is easily caused.

In the toner according to the present exemplary embodiment, a weight average molecular weight of the non-colored particles is preferably in the range of from 5,000 to 40,000, more preferably in the range of from 7,000 to 30,000, and still more preferably in the range of from 10,000 to 25,000. When the weight average molecular weight of the non-colored particles is less than 5,000, there may be the case where the effect for preventing the aggregation of toner particles is not sufficiently exhibited. Meanwhile, when it exceeds 40,000, in the case where the toner is caught by a cleaning blade, the blade is deformed, and as a result, there may be the case where color streaks are generated.

In the toner according to the present exemplary embodiment, a glass transition temperature of the non-colored particles is preferably in the range of from 50° C. to 75° C., more preferably in the range of from 54° C. to 70° C., and still more preferably in the range of from 58° C. to 65° C. When the glass transition temperature of the non-colored particles is lower than 50° C., there may be the case where the effect for preventing the aggregation of toner particles is not sufficiently exhibited. Meanwhile, when it exceeds 75° C., in the case where the toner is caught by a cleaning blade, the blade is deformed, and as a result, there may be the case where color streaks are generated.

In the toner according to the present exemplary embodiment, it is preferable that the polyester resin contains bisphenol A as a constituent component. When the polyester resin contains bisphenol A as a constituent component, the resulting polyester resin is rigid as compared with the case where bisphenol. A is not contained, so that the disintegrating effect for preventing the aggregation of the non-colored particle against the toner particles is raised.

Also, it is necessary that the amount of Sn element contained in the non-colored particles is larger than the amount of Sn element contained in the toner particles. More specifically, the amount of Sn element contained in the non-colored particles is preferably in the range of from 1.1 times to 4 times, and more preferably in the range of from 1.1 times to 3 times the amount of Sn element contained in the toner particles. When the amount of Sn element contained in the non-colored particles is less than 1 time, the generation of toner aggregation is not suppressed; and when it is less than 1.1 times, there may be the case where color streaks are generated due to slight aggregation. Meanwhile, when it exceeds 4 times, the hardness of the non-colored particles increases, so that there may be the case where the cleaning blade is deformed.

Incidentally, the Sn element amount of each of the toner particles and the non-colored particles, and the shape factor SF1, number, weight average molecular weight, glass transition temperature, constituent components and the like of the non-colored particles are measured as described in the Examples as described later.

(Constituent Components of Toner)

The toner particles and the non-colored particles in the electrostatic image developing toner according to the exemplary embodiment of the invention contain a polyester resin. The toner particles further contain a coloring agent and optionally, other components such as a release agent.

The polyester resin is one synthesized from an acid (polyvalent carboxylic acid) and an alcohol (polyhydric alcohol). In the present exemplary embodiment, an "acid-derived constituent component" refers to a constituent site which is an acid component (acid ester in an ester interchange reaction) before the synthesis of the polyester resin, and an "alcohol-derived constituent component" refers to a constituent site which is an alcohol component before the synthesis of the polyester resin.

Examples of the acid-derived constituent component include aromatic carboxylic acids such as terephthalic acid, isophthalic acid, phthalic anhydride, trimellitic anhydride, pyromellitic acid and naphthalene dicarboxylic acid; aliphatic carboxylic acids such as maleic anhydride, fumaric acid, succinic acid, alkenyl succinic anhydrides and adipic acid; and alicyclic carboxylic acids such as cyclohexane dicarboxylic acid. These polyvalent carboxylic acids may be used singly or in combination of two or more kinds thereof. Of these polyvalent carboxylic acids, it is preferable to use an aromatic carboxylic acid, and in order to take a crosslinking structure or a branched structure for the purpose of securing favorable fixability, it is preferable to use a trivalent or higher valent carboxylic acid (for example, trimellitic acid and an acid anhydride thereof) together with a dicarboxylic acid.

Examples of the alcohol-derived constituent component include aliphatic dials such as ethylene glycol, diethylene glycol, triethylene glycol, propylene glycol, butanediol, hexanediol, neopentyl glycol and glycerin; alicyclic diols such as cyclohexanediol, cyclohexanedimethanol and hydrogenated bisphenol A; and aromatic diols such as an ethylene oxide adduct of bisphenol A and a propylene oxide adduct of bisphenol A. These polyhydric alcohols may be used singly or in combination of two or more kinds thereof. Of these polyhydric alcohols, aromatic diols or alicyclic diols are preferable, and above all, those containing bisphenol A as a constituent component are more preferable. Also, in order to take a crosslinking structure or a branched structure for the purpose of securing favorable fixability, a trihydric or higher hydric alcohol (for example, glycerin, trimethylolpropane and pentaerythritol) may be used jointly with the diol.

Incidentally, an acid value of the polyester resin may be adjusted by further adding at least one member of a monocarboxylic acid and a monoalcohol to the polyester resin obtained by polycondensation of the acid-derived constituent component and the alcohol-derived constituent compound, thereby esterifying at least one of the hydroxyl group and the carboxyl group as a polymerization terminal group. Examples of the monocarboxylic acid include acetic acid, acetic anhydride, trichloroacetic acid, trifluoroacetic acid and propionic anhydride. Examples of the monoalcohol include methanol, ethanol, propanol, octanol, 2-ethylhexanol, trifluoroethanol, trichloroethanol, hexafluoroisopropanol and phenol.

The polyester resin may be manufactured by subjecting the foregoing acid-derived constituent component and alcohol-derived constituent component to a condensation reaction in the usual way. For example, the polyester resin is manufactured by charging and blending the foregoing polyhydric alcohol and polyvalent carboxylic acid and optionally, a catalyst in a reactor equipped with a thermometer, a stirrer and a flow-down type condenser; heating the mixture at from 150° C. to 250° C. in the presence of an inert gas (for example, a nitrogen gas, etc.), thereby continuously removing a low-molecular weight compound produced as a by-product out the reaction system; and stopping the reaction at a point of time of reaching a prescribed acid number, followed by cooling to obtain a desired reaction product.

Examples of the catalyst which may be used at the time of manufacturing the polyester resin include alkali metal compounds of, for example, sodium, lithium, etc.; alkaline earth metal compounds, for example, magnesium, calcium, etc.; metal compounds of, for example, zinc, manganese, antimony, titanium, tin, zirconium, germanium, etc.; phosphorous acid compounds; phosphoric acid compounds; and amine compounds. Of these, it is preferable to use a tin-containing catalyst such as tin, tin formate, tin oxalate, tetraphenyltin, dibutyltin dichloride, dibutyltin oxide and diphenyltin oxide.

Also, at the time of manufacturing the polyester resin, the production of the non-colored particles may be controlled by an addition method of the tin-containing catalyst to the reaction system such as a method in which the tin-containing catalyst is divided into at least two stages and added to the reaction system. Other catalyst may be mixed and used while mainly using the tin-containing catalyst.

In the toner according to the present exemplary embodiment, other amorphous resin than the amorphous polyester resin may be contained. The amorphous resin which may be contained is not particularly limited. Specific examples thereof include homopolymers of monomers such as styrenes, for example, styrene, p-chlorostyrene and α-methylstyrene; acrylic monomers, for example, methyl acrylate, ethyl acrylate, n-propyl acrylate, n-butyl acrylate, lauryl acrylate and 2-ethylhexyl acrylate; methacrylic monomers, for example, methyl methacrylate, ethyl methacrylate, n-propyl methacrylate, lauryl methacrylate and 2-ethylhexyl methacrylate; ethylenically unsaturated acid monomers, for example, acrylic acid, methacrylic acid and sodium styrenesulfonate; vinyl nitriles, for example, acrylonitrile and methacrylonitrile; vinyl ethers, for example, vinyl methyl ether and vinyl isobutyl ether; vinyl ketones, for example, vinyl methyl ketone, vinyl ethyl ketone and vinyl isopropenyl ketone; and olefins, for example, ethylene, propylene and butadiene; and copolymers or mixtures obtained by combining two or more kinds of these monomers. Furthermore, there are exemplified non-vinyl condensation resins such as epoxy resins, polyester resins, polyurethane resins, polyamide resins, cellulose resins and polyether resins, and mixtures thereof with the foregoing vinyl based resins; and graft polymers obtained by polymerizing a vinyl based monomer in the presence of such a non-vinyl condensation resin. These resins may be used singly or in combination of two or more kinds thereof. Of these resins, styrene based resins or acrylic resins are especially preferable.

Specific examples of the release agent include low-molecular weight polyolefins such as polyethylene, polypropylene and polybutene; silicones showing a softening temperature under heating; fatty acid amides such as oleic acid amide, erucic acid amide, ricinoleic acid amide and stearic acid amide; vegetable based waxes such as carnauba wax, rice wax, candelilla wax, Japan wax and jojoba oil; animal based waxes such as bees wax; mineral or petroleum based waxes such as montan wax, ozokerite, ceresin, paraffin wax, microcrystalline wax and Fischer-Tropsch wax; and modified products thereof.

Such a release agent can be used singly, and besides, a combination of two or more kinds thereof may be used. A content of such a release agent is preferably from 1 part by weight to 10 parts by weight, and more preferably from 5 parts by weight to 9 parts by weight based on 100 parts by weight of the binder resin.

The coloring agent which is used for the toner of the present exemplary embodiment may be any of a dye or a pigment. From the viewpoints of light resistance and water resistance, a pigment is more preferable. As the preferred pigment, known pigments such as carbon black, Aniline Black, Aniline Blue, Chalcoyl Blue, Chromium Yellow, Ultramarine Blue, Du Pont Oil Red, Quinoline Yellow, Methylene Blue Chloride, Phthalocyanine Blue, Malachite Green Oxalate, lamp black, rose bengal, quinacridone, Benzidine Yellow, C.I. Pigment Red 48:1, C.I. Pigment Red 57:1, C.I. Pigment Red 122, C.I. Pigment Red 185, C.I. Pigment Yellow 12, C.I. Pigment Yellow 17, C.I. Pigment Yellow 180, C.I. Pigment Yellow 97, C.I. Pigment Yellow 74, C.I. Pigment Blue 15:1 and C.I. Pigment Blue 15:3 may be used. A magnetic powder may be used as the coloring agent. As the magnetic powder, known magnetic materials such as ferromagnetic metals such as cobalt, iron and nickel; and alloys or oxides of a metal, for example, cobalt, iron, nickel, aluminum, lead, magnesium, zinc and manganese may be used.

Such a release agent can be used singly, and besides, a combination of two or more kinds thereof may be used. A content of such a release agent is preferably from 0.1 parts by weight to 40 parts by weight, and more preferably from 1 part by weight to 30 parts by weight based on 100 parts by weight of the binder resin.

Incidentally, by properly selecting the kind of the release agent, a toner of each color such as a yellow toner, a magenta toner, a cyan toner and a black toner is obtained.

Other components are not particularly limited and may be properly selected depending upon the purpose. For example, there are exemplified various known additives such as an inorganic particle and a charge controlling agent.

If desired, an inorganic particle may be added to the toner of the present exemplary embodiment. As the inorganic particle, known inorganic particles such as a silica particle, a titanium oxide particle, an alumina particle and a cerium oxide particle, or particles obtained by hydrophobilizing the surface of the foregoing inorganic particle may be used singly or in combination of two or more kinds thereof. From the viewpoint of not impairing color developability or transparency of a transparent film, a silica particle whose refractive index is smaller than that of the binder resin is preferable. Also, the silica particle may be subjected to a surface treatment of every sort. For example, silica particles obtained by the surface treatment with a silane based coupling agent, a titanium based coupling agent, silicone oil or the like are preferable.

By adding such an inorganic particle, the viscoelasticity of the toner may be adjusted, or image glossiness or impregnation into paper may be adjusted. A content of the inorganic particle is preferably from 0.5% by weight to 20% by weight, and more preferably from 1% by weight to 15% by weight based on 100 parts by weight of the toner raw material.

If desired, a charge controlling agent may be added to the toner of the present exemplary embodiment. As the charge controlling agent, a chromium based azo dye, an iron based azo dye, an aluminum azo dye, a salicylic acid metal complex or the like may be used.

<Manufacturing Method of Electrostatic Image Developing Toner>

It is preferable to manufacture the toner according to the present exemplary embodiment by a wet manufacturing method such as an emulsification aggregation method (aggregation and coalescence method).

A manufacturing method of the electrostatic image developing toner according to the present exemplary embodiment is, for example, a method including an aggregating step of mixing a resin particle liquid dispersion having resin particles dispersed therein, a coloring agent liquid dispersion having a coloring agent dispersed therein and a release agent liquid dispersion having a release agent dispersed therein to form aggregated particles containing the resin particles, the release agent and the coloring agent; a stopping step of adjusting the pH in the aggregation system to stop the growth of aggregation of the aggregated particles; a fusing step of heating the aggregated particles at a temperature of the melting temperature or glass transition temperature of the resin particles or higher, thereby achieving fusion; and a washing step of washing the toner particles obtained by fusion using at least water. The manufacturing method may further include a drying step of drying the toner particles. Also, if desired, the manufacturing method may include a shell layer forming step of after the aggregating step, adding the same or different resin particles to adhere to the surfaces of the aggregated particles.

Respective steps in an example of the manufacturing method of the electrostatic image developing toner are hereunder described in detail. Incidentally, it should not be construed that the manufacturing method of the toner according to the present exemplary embodiment is limited thereto.

[Liquid Dispersion Preparing Step]

In the liquid dispersion preparing step, a resin particle liquid dispersion, a coloring agent liquid dispersion, a release agent liquid dispersion and the like are prepared.

The resin particle liquid dispersion may be prepared by adopting a known phase inversion emulsification method, or adopting a method of heating the resin at a temperature of a glass transition temperature of the resin or higher, followed by emulsification by a mechanical shear force, or the like. On that occasion, an ionic surfactant may be added. Furthermore, the non-colored particles may be separated from the resin particle liquid dispersion by a centrifuge or the like.

The coloring agent liquid dispersion may be, for example, prepared by dispersing coloring agent particles of a desired color such as yellow, cyan, magenta and black in a solvent using an ionic surfactant.

The release agent liquid dispersion may be, for example, prepared by dispersing a release agent in water together with a polymer electrolyte (for example, an ionic surfactant, a polymer acid, a polymer base, etc.), heating the dispersion at a temperature of a melting temperature of the release agent or higher and granulating it by a homogenizer or pressure discharge type dispersion machine capable of applying a strong shear force.

[Aggregating Step]

In the aggregating step, the resin particle liquid dispersion, the coloring agent liquid dispersion and the release agent liquid dispersion are mixed, and the resin particles and the release agent and optionally, the coloring agent are subjected to hetero-aggregation, thereby forming aggregated particles (core aggregated particles) having a diameter substantially close to a desired toner diameter.

[Shell Layer Forming Step]

In the shell layer forming step, the resin particles are adhered onto the surfaces of the core aggregated particles using the resin particle liquid dispersion containing the resin particles, to form a coating layer (shell layer) having a desired thickness. There are thus obtained aggregated particles having a core/shell structure in which the shell layer is formed on the surface of the core aggregated particle (core/shell aggregated particles).

Incidentally, each of the aggregating step and the shell layer forming step may be repeatedly carried out by dividing stepwise each of the steps plural times.

Here, for the purpose of making it easy to adjust each of the toner diameter and the particle diameter distribution, a volume average particle diameter of each of the resin particles, the coloring agent and the release agent which are used in the aggregation step and the shell layer forming step is preferably not more than 1 μM, and more preferably in the range of from 100 nm to 300 nm.

The volume average particle diameter is measured using a laser diffraction type particle diameter distribution analyzer (LA-700, manufactured by Horiba, Ltd.). As for a measurement method, a sample in a state of a liquid dispersion is adjusted so as to have a solid content of about 2 g, and ion exchanged water is added thereto to make to about 40 mL. This is charged in a cell so as to reach an appropriate concentration, and after elapsing about 2 minutes, at a point where the concentration in the cell becomes substantially stable, the measurement is performed. A volume particle diameter of every obtained channel is accumulated from the small volume particle diameter side, and the particle diameter at 50% accumulation is defined as the volume average particle diameter.

[Stopping Step]

In the stopping step, the pH in the aggregation system is adjusted, thereby stopping the aggregation and growth of the aggregated particles. For example, the pH in the aggregation system is adjusted within the range of from 6 to 9, thereby stopping the aggregated particles.

[Fusing Step]

In the fusing step (fusing and coalescing step), first of all, in a solution containing the aggregated particles obtained through the aggregating step and optionally, the shell forming step, heating is performed at a temperature of the melting point or glass transition temperature of the resin particles contained in the aggregated particles, thereby achieving fusion and coalescence. There are thus obtained toner particles.

[Washing Step]

In the washing step, a liquid dispersion of the toner particles obtained in the fusing step is subjected to at least displacement washing with ion exchanged water or the like to achieve solid-liquid separation. Though the solid-liquid separation method is not particularly limited, from the standpoints of productivity and the like, suction filtration, pressure filtration or the like is preferably adopted.

[Drying Step]

In the drying step, a wet cake having been subjected to solid-liquid separation is dried to obtain toner particles. Though the drying step is not particularly limited, from the standpoints of productivity and the like, freeze-drying, flash jet drying, fluidized drying, vibration-type fluidized drying or the like is preferably adopted.

<Physical Properties of Electrostatic Image Developing Toner>

A volume average particle diameter of the electrostatic image developing toner according to the present exemplary embodiment is preferably in the range of from 4 μm to 8 μm, and more preferably in the range of from 5 μm to 7 μm. Also, a number average particle diameter of the electrostatic image developing toner according to the present exemplary embodiment is preferably in the range of from 3 μm to 7 μm, and more preferably in the range of from 4 μm to 6 μm.

The measurement of the foregoing volume average particle diameter and number average particle diameter is performed using Coulter Multisizer Type II (manufactured by Beckman Coulter Inc.) at an aperture diameter of 50 μm. At that time, the measurement is performed by dispersing the toner in an electrolyte aqueous solution (an ISOTON aqueous solution) and ultrasonically dispersing the dispersion for 30 seconds.

Also, a volume average particle size distribution index $GSD_v$ of the electrostatic image developing toner according to the present exemplary embodiment is not more than 1.27, and preferably not more than 1.25. When the $GSD_v$ exceeds 1.27, the particle diameter distribution does not become sharp, the resolution is lowered, and there may be the case where an image quality defect such as toner scattering and fog is caused.

Incidentally, the volume average particle diameter $D50_v$ and the volume average particle size distribution index $GSD_v$ are determined in the following manner. Cumulative distribution of each of the volume and the number is drawn from the small diameter side with respect to the particle diameter range (channel) divided on the basis of the particle diameter distribution measured using the foregoing Coulter Multisizer Type II (manufactured by Beckman Coulter Inc.), and the particle diameter at 16% accumulation is defined as $D16_v$ by volume and $D16_p$ by number, the particle diameter at 50% accumulation is defined as $D50_v$ by volume and $D50_p$ by number, and the particle diameter at 84% accumulation is defined as $D84_v$ by volume and $D84_p$ by number. On that occasion, $D50_v$ represents a volume average particle diameter, and the volume average particle size distribution index ($GSD_v$) is determined as $(D84_v/D16_v)^{1/2}$. Incidentally, $(D84_p/D16_p)^{1/2}$ represents a number average particle diameter distribution index.

Also, a shape factor SF1 of the electrostatic image developing toner according to the present exemplary embodiment, which is represented by the following expression, is preferably in the range of from 110 to 140, and more preferably in the range of from 115 to 130.

$$SF1=(ML^2/A)\times(\pi/4)\times100$$

In the foregoing expression, ML represents a maximum length (μm) of the toner; and A represents a projected area ($\mu m^2$) of the toner.

When the shape factor SF1 of the toner is smaller than 110 or exceeds 140, there is a concern that excellent chargeability, cleaning properties and transferability are not obtained for long periods.

Incidentally, the shape factor SF1 is measured using a Luzex image analyze (FT, manufactured by Nireco Corporation) in the following manner. First of all, an optical microscopic image of the toner spread on a slide glass is incorporated into a Luzex image analyzer through a video camera, the maximum length (ML) and projected area (A) are determined on 50 toners, and with respect to the respective toners, $SF1=(ML^2/A)\times(\pi/4)\times100$ is calculated, and an average value thereof is determined as the shape factor SF1.

<Electrostatic Image Developer>

In the present exemplary embodiment, the electrostatic image developer is not particularly limited, except for the fact that it contains the electrostatic image developing toner of the present exemplary embodiment, and a proper component composition may be taken depending upon the purpose. When the electrostatic image developing toner is used singly, the electrostatic image developer in the present exemplary embodiment is a one-component electrostatic image developer, and when the electrostatic image developing toner is used in combination with a carrier, the electrostatic image developer in the present exemplary embodiment is a two-component electrostatic image developer, For example, in the case of using a carrier, the carrier is not particularly limited. There are exemplified carriers which are known per se, and known carriers such as a resin-coated carrier are useful.

Specific examples of the carrier include the following resin-coated carriers. Examples of a nucleus particle of the carrier include usual iron powder, ferrite and magnetite moldings. A volume average particle diameter thereof is in the range of from about 30 μm to 200 μm.

Also, examples of the coating resin of the resin-coated carrier include homopolymers of monomers such as styrenes, for example, styrene, p-chlorostyrene and α-methylstyrene; α-methylene fatty acid monocarboxylic acids, for example, methyl acrylate, ethyl acrylate, n-propyl acrylate, lauryl acrylate and 2-ethylhexyl acrylate; nitrogen-containing acryls, for example, dimethylaminoethyl methacrylate; vinyl nitriles, for example, acrylonitrile and methacrylonitrile; vinylpyridines, for example, 2-vinylpyridine and 4-vinylpyridine; vinyl ethers, for example, vinyl methyl ether and vinyl isobutyl ether; vinyl ketones, for example, vinyl methyl ketone, vinyl ethyl ketone, vinyl isopropenyl ketone; and olefins, for example, ethylene and propylene; and vinyl based fluorine-containing monomers, for example, vinylidene fluoride, tetrafluoroethylene and hexafluoroethylene; and copolymers composed of two or more kinds of these monomers. Furthermore, there are exemplified silicone resins, for example, methyl silicone and methyl phenyl silicone, polyesters containing bisphenol, glycol, etc., epoxy resins, polyurethane resins, polyamide resins, cellulose resins, polyether resins and polycarbonate resins. These resins may be used singly or in combination of two or more kinds thereof. A coating amount of the coating resin is preferably in the range of from about 0.1 parts by weight to 10 parts by weight, and more preferably in the range of from 0.5 parts by weight to 3.0 parts by weight.

For the manufacture of the carrier, a heating type kneader, a heating type Henschel mixer, a UM mixer or the like may be used. A heating type fluidized tumbling bed, a heating type kiln or the like may also be used depending upon the amount of the coating resin.

A mixing ratio of the electrostatic image developing toner of the present exemplary embodiment and the carrier in the electrostatic image developer is not particularly limited and may be properly selected depending upon the purpose.

<Toner Cartridge>

The toner cartridge according to the present exemplary embodiment is not particularly limited so far as it contains the electrostatic image developing toner of the present exemplary embodiment. The toner cartridge is, for example, detachable relative to an image forming apparatus provided with a developing unit and stores the electrostatic image developing toner of the present exemplary embodiment as a toner to be supplied into this developing unit.

<Process Cartridge>

The process cartridge according to the present exemplary embodiment includes an image holding member and a developing unit for developing an electrostatic latent image formed on the surface of the image holding member with the developer to form a developed image. If desired, the process cartridge of the present exemplary embodiment may include at least one member selected from the group consisting of a charging unit for charging the surface of the image holding member, a latent image forming unit for forming a latent image on the surface of the charged image holding member, a transfer unit for transferring the developed image formed on the surface of the image holding member onto a transfer-receiving member, an image holding member cleaning unit for removing the residual toner or the like remained on the surface of the image holding member after transfer and cleaning it, and a fixing unit for fixing the developed image transferred onto the transfer-receiving member.

A diagrammatic configuration of an example of the process cartridge according to the exemplary embodiment of the invention is shown in FIG. 1, and its configuration is described. In a process cartridge 1, a photoreceptor (electrophotographic receptor) 14 that is an image holding member on which an electrostatic latent image is formed; a charging device 10 that is a charging unit for charging the surface of the photoreceptor 14; a developing device 16 that is a developing unit for adhering a toner to the electrostatic latent image formed on the surface of the photoreceptor 14 to form a developed image; and a cleaning blade 20 that is an image holding member cleaning unit for removing the residual toner or the like remained on the surface of the photoreceptor 14 after transfer and cleaning it are integrally supported, and the process cartridge 1 is detachable relative to an image forming apparatus. When installed in the image forming apparatus, the charging device 10, an exposure device 12 that is a latent image forming unit for forming an electrostatic latent image on the surface of the photoreceptor 14 by laser light or reflected light of an original or the like, the developing device 16, a transfer roll 18 that is a transfer unit for transferring a developed image on the surface of the photoreceptor 14 onto a recording paper 24 that is a transfer-receiving member; and the cleaning blade 20 are disposed in this order on the surroundings of the photoreceptor 14. Incidentally, the description of other functional units which are usually required in an electrophotographic process is omitted.

The action of the process cartridge 1 according to the present exemplary embodiment is described.

First of all, the surface of the photoreceptor 14 is charged by the charging device 10 (charging step). Subsequently, light is applied onto the surface of the photoreceptor 14 by the exposure device 12, and an electrification charge in a portion where light is applied is removed, whereby an electrostatic latent image (electrostatic image) is formed depending upon the image information (latent image forming step). Thereafter, the electrostatic latent image is developed by the developing device 16, whereby a developed image is formed on the surface of the photoreceptor 14 (developing step). For example, in the case of a digital type electrophotographic copier using an organic photoreceptor as the photoreceptor 14 and using laser beam light as the exposure device 12, the surface of the photoreceptor 14 is negatively charged by the charging device 10, a digital latent image is formed in a dot state by the laser beam light, and a toner is imparted in a portion where the laser beam light is applied by the developing device 16, thereby forming a visual image. In that case, a minus bias is impressed to the developing device 16. Subsequently, the recording paper 24 that is a transfer-receiving member is overlaid on this developed image by the transfer roll 18, and a charge with a reverse polarity to the toner is given to the recording paper 24 from the back side of the recording paper 24, whereby the developed image is transferred onto the recording paper 24 by an electrostatic force (transfer step). In a fixing device having fixing rolls 22 as a fixing unit, the transferred developed image is applied with heat and pressure, and then fused and fixed onto the recording paper 24 (fixing step). Meanwhile, a residue such as the toner remained on the surface of the photoreceptor 14 without being transferred is removed by the cleaning blade 20 (image holding member cleaning step). One cycle is completed by a series of processes of from the charging step to the image holding member cleaning step. Incidentally, in FIG. 1, though the developed image is transferred directly onto the recording paper 24 by the transfer roll 18, the transfer may be achieved through an intermediate transfer material such as an intermediate transfer belt.

As for the charging device 10 that is a charging unit, for example, a charger such as a corotron as shown in FIG. 1 is used, but a conductive or semiconductive charging roll may be used. In a contact type charger using a conductive or semiconductive charging roll, a direct current or a direct current superposed on an alternating current may be impressed to the photoreceptor 14. For example, the surface of the photoreceptor 14 is charged by the charging device 10 by generating a discharge in a microspace near the contact part with photoreceptor 14. Incidentally, in general, the surface of the photoreceptor 14 is charged to from −300 V to −1,000 V. Also, the foregoing conductive or semiconductive charging roll may have a single-layer structure or a multiple structure. Furthermore, a mechanism of cleaning the surface of the charging roll may be provided.

The photoreceptor 14 has a function of allowing at least an electrostatic latent image (electrostatic charge image) to be formed thereon. In an electrophotographic photoreceptor, if desired, a subbing layer, a charge generation layer containing a charge generating substance and a charge transport layer containing a charge transport substance are formed in this order on the outer circumferential surface of a cylindrical conductive substrate. The stacking order of the chare generating layer and the charge transport layer may be reversed. This is a laminate type photoreceptor obtained by incorporating a charge generating substance and a charge transport substance are incorporated into separate layers (a charge generating layer and a charge transport layer) and stacking the layers, but the photoreceptor may be a single-layer photoreceptor containing both a charge generating substance and a charge transport substance in the same layer. A laminate type photoreceptor is preferable. Also, the photoreceptor may have an interlayer between the subbing layer and the photoreceptor. Also, a protective layer may be provided on the photosensitive layer. Also, the present exemplary embodiment is not limited to an organic photosensitive layer, but a different kind of photosensitive layer, such as amorphous silicon photosensitive film, may also be used.

The exposure device 12 is not particularly limited, and examples thereof include optical instruments capable of exposing the surface of the photoreceptor 14 with a light source such as semiconductor laser light, LED (light emitting diode) light and liquid crystal shutter light in a desired image pattern, such as a laser light system and an LED array.

The developing unit has a function to form a developed image by developing an electrostatic latent image formed on the photoreceptor 14 with a one-component developer or two-component developer containing an electrostatic image developing toner. Such a developing device is not particularly limited so far as it has the foregoing function and may be properly selected depending upon the purpose. The developing device may be any of a mode where the toner layer comes into contact with the photoreceptor 14 or a mode where the toner layer does not come into contact with the photoreceptor 14. Examples thereof include known developing units such as a developing unit having a function to adhere an electrostatic image developing toner onto the photoreceptor 14 using the developing device 16 as shown in FIG. 1; and a developing unit having a function to adhere a toner onto the photoreceptor 14 using a brush or the like.

The developing device 16 in the process cartridge according to the present exemplary embodiment has a developer holding member for holding a developer and developing an electrostatic latent image formed on the surface of the image holding member to form a developed image and a layer thickness regulating member for regulating the layer thickness of the developer on the surface of the developer holding member. A gap between the developer holding member and the layer thickness regulating member is in the range of from 100 μm to 500 μm, and preferably in the range of from 200 μm to 400 μm. When aggregation of the toner occurs, there is a concern that clogging is generated between the gap between the developer holding member and the layer thickness regulating member. However, the toner according to the present exemplary embodiment is hardly aggregated even after storage under a specified heat condition and exhibits excellent storage stability. Therefore, the gap between the developer holding member and the layer thickness regulating member may be allowed to fall within the range of from 100 μm to 500 μm, a value of which is narrower than the usual value.

As the transfer device that is a transfer unit, for example, a device of giving a charge with a reverse polarity to the toner to the recording paper 24 from the back side of the recording paper 24, thereby transferring a toner image onto the recording paper 24 by an electrostatic force; or a transfer roll and a transfer roll pressing device using a conductive or semiconductive roll coming into direct contact with the surface of the recording paper 24 through the recording paper 24 to transfer a toner image as shown in FIG. 1 may be used. As a transfer current to be impressed to the image holding member, a direct current or a direct current superposed on an alternating current may be impressed to the transfer roll. The transfer roll may be arbitrarily set up depending upon a width of an image region to be charged, a shape of the transfer charger, an aperture width, a process speed (peripheral speed), etc. Also, for the purpose of reducing the cost, a single-layer foamed roll or the like is suitably used as the transfer roll. As a transfer mode, any of a mode of achieving direct transfer onto the recording paper 24 or a mode of achieving transfer onto the recording paper 24 through an intermediate transfer material may be adopted.

As the intermediate transfer member, a known intermediate transfer member may be used. Examples of a material which is used for the intermediate transfer member include a polycarbonate resin (PC), polyvinylidene fluoride (PVDF), a polyalkylene phthalate, and a blend material such as PC/polyalkylene terephthalate (PAT), ethylene tetrafluoroethylene copolymer (ETFE)/PC, ETFE/PAT and PC/PAT. From the viewpoint of mechanical strength, an intermediate transfer belt using a thermosetting polyimide resin is preferable.

As for the image holding member cleaning unit, a cleaning unit employing a blade cleaning system, a brush cleaning system or a roll cleaning system may be properly chosen so far as it cleans the residual toner or the like on the image holding member. Above all, use of a cleaning blade is preferable. Also, examples of a material of the cleaning blade include a urethane rubber, a neoprene rubber and a silicone rubber. Of these, it is especially preferable to use a polyurethane elastic material because of its excellent abrasion resistance. However, in the case of using a toner with high transfer efficiency, an exemplary embodiment not using the cleaning blade 20 may be employed.

The fixing device as the fixing unit is not particularly limited so far as it is a unit of fixing the developed image transferred onto the recording paper 24 by heating, pressurization, heating and pressurization or the like. For example, a fixing device provided with a heat roll and a pressure roll is used.

Examples of the recording paper 24 that is a transfer-receiving material onto which a developed image is transferred include plain paper and an OHP sheet, which are used for a copier, a printer or the like of the electrophotographic system. For the purpose of more enhancing the smoothness of the image surface after fixing, the surface of the transfer material is preferably as smooth as possible, and for example, coated paper obtained by coating the surface of plain paper with a resin or the like, art paper for printing or the like may be preferably used.

<Image Forming Apparatus>

The image forming apparatus according to the present exemplary embodiment includes an image holding member; a charging unit for charging the surface of the image holding member; a latent image forming unit for forming an electrostatic latent image on the surface of the image holding member; a developing unit for developing the electrostatic latent image formed on the surface of the image holding member with a developer to form a developed image; and a transfer unit for transferring the developed image onto a transfer-receiving member. If desired, the image forming apparatus of the present exemplary embodiment may include at least one member selected from the group consisting of a fixing unit for fixing the developed image transferred onto the transfer-receiving member and an image holding member cleaning unit for removing the residual toner or the like remained on the surface of the image holding member after transfer and cleaning it. Also, the image forming apparatus according to the present exemplary embodiment may be one using the foregoing process cartridge.

Figure 2:
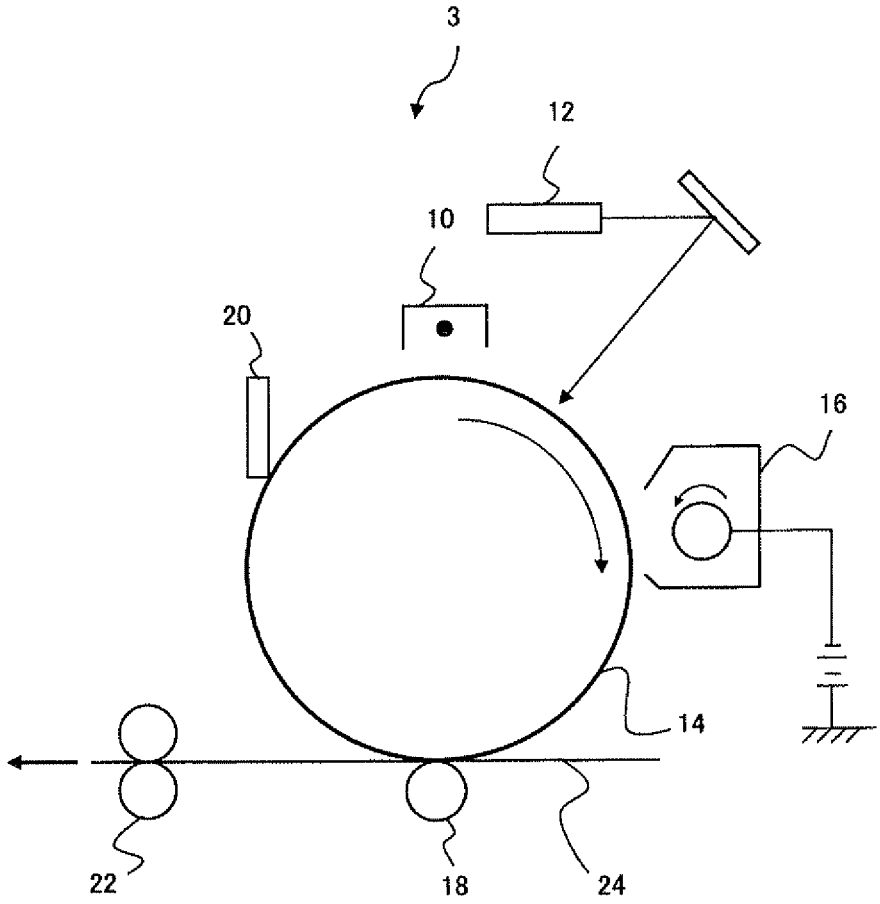
FIG. 2 is a diagrammatic configuration view showing an example of an image forming apparatus according to an exemplary embodiment of the invention.

A diagrammatic configuration of an example of the image forming apparatus according to the present exemplary embodiment is shown in FIG. 2, and its configuration is described. An image forming apparatus 3 includes a photoreceptor 14 that is an image holding member on which an electrostatic latent image is formed; a charging device 10 that is a charging unit for charging the surface of the photoreceptor 14; an exposure device 12 that is a latent image forming unit for forming an electrostatic latent image on the surface of the photoreceptor 14 by laser light or reflected light of an original or the like; a developing device 16 that is a developing unit for adhering a toner to the electrostatic latent image formed on the surface of the photoreceptor 14 to form a developed image; a transfer roll 18 that is a transfer unit for transferring the developed image on the surface of the photoreceptor 14 onto a recording paper 24 that is a transfer-receiving member; and a cleaning blade 20 that is an image holding member cleaning unit for removing the residual toner or the like remained on the surface of the photoreceptor 14 after transfer and cleaning it. In the image forming apparatus 3, the charging device 10, the exposure device 12, the developing device 16, the transfer roll 18 and the cleaning blade 20 are disposed in this order on the surroundings of the photoreceptor 14. Also, the image forming device 3 includes a fixing device having a fixing roll 22 that is a fixing unit. Incidentally, the description of other functional units which are usually required in an electrophotographic process is omitted. Each of the constitutions of the image forming apparatus 3 and the action at the time of image forming are the same as those in the process cartridge 1 shown in FIG. 1.

The developing device 16 in the image forming apparatus according to the present exemplary embodiment has a developer holding member for holding a developer and developing an electrostatic latent image formed on the surface of the image holding member to form a developed image and a layer thickness regulating member for regulating the layer thickness of the developer on the surface of the developer holding member. From the standpoint of suppressing the generation of color streaks, a gap between the developer holding member and the layer thickness regulating member is in the range of from 100 μm to 500 μm, and preferably in the range of from 200 μm to 400 μm. When the gap between the developer holding member and the layer thickness regulating member is less than 100 μm, there may be the case where the deterioration of aggregation properties cannot be controlled by a pressure among the developers regulated by the layer thickness regulating member; whereas when it exceeds 500 μm, since the amount of the developer existing between the developer holding member and the layer thickness regulating member is too high, the aggregation is rather easy to occur. As a result, in the both cases, there is a concern that color streaks are easily caused.

Each of the configurations of the process cartridge and the image forming apparatus according to the present exemplary embodiments is not limited thereto, and known configurations may be applied as each of configurations of a process cartridge and an image forming apparatus of a conventional electrophotographic mode. That is, with respect to the charging unit, the latent image forming unit, the developing unit, the transfer unit, the image holding member cleaning unit, the destaticization unit, the paper feed unit, the conveying unit, the image controlling unit and the like, those which are conventionally known are properly adopted as the need arises. These configurations are not particularly limited in the present exemplary embodiments.

EXAMPLES

The invention is hereunder described in more detail by referring to Examples and Comparative Examples, but it should not be construed that the invention is limited to the following Examples.

First of all, in the Examples, each of measurements is carried out as follows.

[Measurement Method of Glass Transition Temperature]

A glass transition temperature of each of toner and non-colored particles is determined by means of a DSC (differential scanning calorimetry) measurement method and determined from a main maximum peak measured in conformity with ASTM D3418-8.

For the measurement of a main maximum peak, DSC-7, manufactured by Perkin Elmer Co., Ltd. is used. For the temperature correction of a detection section of this apparatus, melting temperatures of indium and zinc are used, and for the correction of quantity of heat, a heat of fusion of indium is used. A sample is measured on an aluminum-made pan at a temperature rise rate of 10° C./min while using a blank pan for control.

[Measurement Method of Molecular Weight and Molecular Weight Distribution]

The molecular weight distribution is measured under the following condition. "HLC-8120GPC, SC-8020 apparatus, manufactured by Tosoh Corporation" is used for GPC; two columns of "TSK gel, Super HM-H (6.0 mm ID×15 cm×2), manufactured by Tosoh Corporation" are used; and THF (tetrahydrofuran) is used as an eluting solution. As for the experimental condition, a sample concentration is 0.5%; a flow rate is 0.6 mL/min; a sample injection amount is 10 μL; a measurement temperature is 40° C.; and an IR detector is used. A calibration curve is prepared from 10 samples of polystyrene standard samples TSK Standards, manufactured by Tosoh Corporation: A-500, F-1, F-10, F-80, F-380, A-2500, F-4, F-40, F-128 and F-700.

[Measurement Method of Number and SF1 of Non-Colored Particles not Containing a Coloring Agent]

The non-colored particles not containing a coloring agent in the toner are observed by an optical microscope of 10×400 times, and the number of non-colored particles in 5,000 toner particles is counted.

[Measurement Method of Shape Factor SF1]

The shape factor SF1 of each of toner and non-colored particles is calculated according to the following expression.

$$SF1=(ML^2/A)\times(\pi/4)\times 100$$

In the foregoing expression, ML represents a maximum length (μm) of the toner; and A represents a projected area ($\mu m^2$) of the toner.

The shape factor SF1 is measured using a Luzex image analyze (FT, manufactured by Nireco Corporation) in the following manner. First of all, an optical microscopic image of the toner spread on a slide glass is incorporated into a Luzex image analyzer through a video camera, the maximum length (ML) and projected area (A) are determined on 50 toners, and with respect to the respective toners, $SF1=(ML^2/A)\times(\pi/4)\times 100$ is calculated, and an average value thereof is determined as the shape factor SF1.

[Measurement Method of Amount of Sn Element]

The amount of Sn element contained in each of toner and non-colored particles is measured from a ratio of the Sn element and the carbon element detected from each of the toner surface and the non-colored particle surface by using a scanning electron microscope (manufactured by Hitachi Kyowa Engineering Co., Ltd.; hereinafter SEM-EDX). Specifically, the ratio of the carbon amount and the Sn amount is measured, and this is compared between the toner and non-colored particles. The resulting ratio is defined as an amount ratio in the amount of tin element between the toner and non-colored particles.

[Measurement Method of Colored Material in Non-Colored Particles]

In the case where a special metal such as Cu and Ca is contained in the coloring agent, the amount of the coloring agent contained in the non-colored particles is determined by comparing a toner section and a non-colored particle section by means of sectional observation by the foregoing SEM-EDX, or by dissolving the non-colored particles in a solvent such as acetone and ethyl acetate and following the Lambert-Beer's law from the weight of the particles and solvent amount and the absorption wavelength and absorption coefficient of the absorbed coloring agent. Incidentally, in the case where the absorption coefficient of the measured coloring agent is unknown, the amount of the coloring agent is measured by thermally decomposing the toner by DTA, measuring the amount of a component which is decomposed at the highest temperature, determining the concentration of the coloring agent in the toner from this, further dissolving the toner in the foregoing solvent and determining the absorption coefficient from the weight of the toner, the solvent amount and the absorption wavelength of the coloring agent to be absorbed.

[Component Analysis Method in Non-Colored Particles]

The matter that a polyester resin is contained in the non-colored particles and the constituent components of the polyester resin, are confirmed by the absorption wavelength of ester by using an infrared spectrophotometer (FT-IR, manufactured by Shimadzu Corporation).

(Preparation of Polyester Resin 1)

| | |
|---|---|
| Dimethyl terephthalate (manufactured by Wako Pure Chemical Industries, Ltd.): | 10 parts by mole |
| Dimethyl fumarate (manufactured by Wako Pure Chemical Industries, Ltd.): | 87 parts by mole |
| n-Dodecenyl succinic acid (manufactured by Wako Pure Chemical Industries, Ltd.): | 3 parts by mole |
| Bisphenol A ethylene oxide 2-mole adduct (manufactured by Wako Pure Chemical Industries, Ltd.): | 85 parts by mole |
| Bisphenol A propylene oxide 2-mole adduct (manufactured by Wako Pure Chemical Industries, Ltd.): | 15 parts by mole |
| Dibutyltin oxide (manufactured by Wako Pure Chemical Industries, Ltd.): | 0.1 parts by mole |

The foregoing components are charged in a nitrogen-purged flask, allowed to react at 150° C. for 4 hours and further allowed to react under reduced pressure at 200° C. for 6 hours. Thereafter, 8 parts by weight of trimellitic anhydride and 0.02 parts by mole of dibutyltin oxide are added, and the mixture is allowed to react under reduced pressure for 30 minutes, thereby obtaining a polyester resin 1 having a weigh average molecular weight (Mw) of 12,5000 and a glass transition temperature (Tg) of 60° C.

(Preparation of Resin Particle Liquid Dispersion 1)

The foregoing polyester resin 1 in a molten state is transferred into CAVITRON CD1010 (manufactured by Eurotec, Ltd.) at a rate of 100 g per minute. Dilute ammonia water having a concentration of 0.37% by weight, which is obtained by diluting reagent ammonia water with ion exchanged water, is charged in a separately prepared aqueous medium tank and transferred into the foregoing CAVITRON at a rate of 0.1 L per minute while heating at 120° C. by a heat exchanger simultaneously with the foregoing molten polyester resin. The CAVITRON is operated under a condition at a rotation speed of a rotator of 60 Hz and at a pressure of 5 kg/cm$^2$, thereby obtaining a resin particle liquid dispersion having a volume average particle diameter of 160 nm and a solids content of 30%. Furthermore, the resulting resin particle liquid dispersion is centrifuged under the following condition to obtain a resin particle liquid dispersion 1.

[Centrifugation Condition]

Apparatus: Centrifuge, himac CR 22G (manufactured by Hitachi, Ltd.)

Rotation number: 12,000 rpm

Separation time: 30 minutes

Solvent: Methyl ethyl ketone (MEK)

Sample concentration: 10% by weight solution (Preparation of Polyester Resin 2)

A polyester resin 2 is obtained in the same manner as in the polyester resin 1, except that in the preparation of the polyester resin 1, the amount of dibutyltin oxide to be first added is changed from 0.1 parts by mole to 0.08 parts by mole and that the reaction at 150° C. for 4 hours and further under reduced pressure at 200° C. for 6 hours is changed to a reaction at 214° C. for 6 hours.

(Preparation of Polyester Resin 3)

A polyester resin 3 is obtained in the same manner as in the polyester resin 1, except that in the preparation of the polyester resin 1, the amount of dibutyltin oxide to be first added is changed from 0.1 parts by mole to 0.08 parts by mole and that the reaction at 150° C. for 4 hours and further under reduced pressure at 200° C. for 6 hours is changed to a reaction at 218° C. for 6 hours.

(Preparation of Polyester Resin 4)

A polyester resin 4 is obtained in the same manner as in the polyester resin 1, except that in the preparation of the polyester resin 1, the amount of dibutyltin oxide to be first added is changed from 0.1 parts by mole to 0.07 parts by mole and that the reaction at 150° C. for 4 hours and further under reduced pressure at 200° C. for 6 hours is changed to a reaction at 224° C. for 6 hours.

(Preparation of Polyester Resin 5)

A polyester resin 5 is obtained in the same manner as in the polyester resin 1, except that in the preparation of the polyester resin 1, the amount of dibutyltin oxide to be first added is changed from 0.1 parts by mole to 0.07 parts by mole and that the reaction at 150° C. for 4 hours and further under reduced pressure at 200° C. for 6 hours is changed to a reaction at 228° C. for 6 hours.

(Preparation of Polyester Resin 6)

A polyester resin 6 is obtained in the same manner as in the polyester resin 1, except that in the preparation of the polyester resin 1, the amount of dibutyltin oxide to be first added is changed from 0.1 parts by mole to 0.09 parts by mole and that the reaction at 150° C. for 4 hours and further under reduced pressure at 200° C. for 6 hours is changed to a reaction at 208° C. for 6 hours.

(Preparation of Resin Particle Liquid Dispersions 2 to 6)

The resin dispersion and centrifugation are carried out under the same conditions as those in the preparation of the resin particle liquid dispersion 1 from the polyester resin 1, thereby obtaining resin particle liquid dispersions 2 to 6.

(Preparation of Resin Particle Liquid Dispersion 7)

A resin particle liquid dispersion 7 is prepared in the same manner as that in the manufacture of the resin particle liquid dispersion 1, except that in the manufacture of the resin particle liquid dispersion 1, the time for the centrifugation is changed from 30 minutes to 22 minutes.

(Preparation of Resin Particle Liquid Dispersion 8)

A resin particle liquid dispersion 8 is prepared in the same manner as that in the manufacture of the resin particle liquid dispersion 2, except that in the manufacture of the resin particle liquid dispersion 2, the time for the centrifugation is changed from 30 minutes to 22 minutes.

(Preparation of Resin Particle Liquid Dispersion 9)

A resin particle liquid dispersion 9 is prepared in the same manner as that in the manufacture of the resin particle liquid dispersion 3, except that in the manufacture of the resin particle liquid dispersion 3, the time for the centrifugation is changed from 30 minutes to 22 minutes.

(Preparation of resin particle liquid dispersion 10)

A resin particle liquid dispersion 10 is prepared in the same manner as that in the manufacture of the resin particle liquid dispersion 1, except that in the manufacture of the resin particle liquid dispersion 1, the time for the centrifugation is changed from 30 minutes to 19 minutes.

(Preparation of Resin Particle Liquid Dispersion 11)

A resin particle liquid dispersion 11 is prepared in the same manner as that in the manufacture of the resin particle liquid dispersion 2, except that in the manufacture of the resin particle liquid dispersion 2, the time for the centrifugation is changed from 30 minutes to 19 minutes.

(Preparation of Resin Particle Liquid Dispersion 12)

A resin particle liquid dispersion 12 is prepared in the same manner as that in the manufacture of the resin particle liquid dispersion 1, except that in the manufacture of the resin particle liquid dispersion 1, the time for the centrifugation is changed from 30 minutes to 15 minutes.

(Preparation of Resin Particle Liquid Dispersion 13)

A resin particle liquid dispersion 13 is prepared in the same manner as that in the manufacture of the resin particle liquid dispersion 4, except that in the manufacture of the resin particle liquid dispersion 4, the time for the centrifugation is changed from 30 minutes to 15 minutes.

(Preparation of Resin Particle Liquid Dispersion 14)

A resin particle liquid dispersion 14 is prepared in the same manner as that in the manufacture of the resin particle liquid dispersion 5, except that in the manufacture of the resin particle liquid dispersion 5, the time for the centrifugation is changed from 30 minutes to 15 minutes.

(Preparation of Resin Particle Liquid Dispersion 15)

A resin particle liquid dispersion 15 is prepared in the same manner as that in the manufacture of the resin particle liquid dispersion 1, except that in the manufacture of the resin particle liquid dispersion 1, as for the centrifugation condition, the rotation number is changed to 11,000 rpm, and the time is changed to 12 minutes.

(Preparation of Resin Particle Liquid Dispersion 16)

A resin particle liquid dispersion 16 is prepared in the same manner as that in the manufacture of the resin particle liquid dispersion 4, except that in the manufacture of the resin particle liquid dispersion 4, the time for the centrifugation is changed from 30 minutes to 11 minutes.

(Preparation of Resin Particle Liquid Dispersion 17)

A resin particle liquid dispersion 17 is prepared in the same manner as that in the manufacture of the resin particle liquid dispersion 1, except that in the manufacture of the resin particle liquid dispersion 1, as for the centrifugation condition, the rotation number is changed to 15,000 rpm, and the time is changed to 45 minutes.

(Preparation of Resin Particle Liquid Dispersion 18)

A resin particle liquid dispersion 18 is prepared in the same manner as that in the manufacture of the resin particle liquid dispersion 2, except that in the manufacture of the resin particle liquid dispersion 2, as for the centrifugation condition, the rotation number is changed to 15,000 rpm, and the time is changed to 45 minutes.

(Preparation of Resin Particle Liquid Dispersion 19)

A resin particle liquid dispersion 19 is prepared in the same manner as that in the manufacture of the resin particle liquid dispersion 4, except that in the manufacture of the resin particle liquid dispersion 4, as for the centrifugation condition, the rotation number is changed to 15,000 rpm, and the time is changed to 45 minutes.

(Preparation of Polyester Resin 7 and Resin Particle Liquid Dispersion 20)

A polyester resin 7 is obtained in the same manner as in the polyester resin 6, except that in the preparation of the polyester resin 6, the amount of dibutyltin oxide to be first added is changed from 0.09 parts by mole to 0.01 parts by mole and that the reaction under reduced pressure at 208° C. for 6 hours is changed to a reaction at 208° C. for 2.9 hours. Furthermore, the polyester resin 7 is subjected to resin dispersion and centrifugation treatment under the same conditions as those in the preparation of the resin particle liquid dispersion 6 from the polyester resin 6, thereby obtaining a resin particle liquid dispersion 20.

(Preparation of Polyester Resin 8 and Resin Particle Liquid Dispersion 21)

A polyester resin 8 is obtained in the same manner as in the polyester resin 6, except that in the preparation of the polyester resin 6, the amount of dibutyltin oxide to be first added is changed from 0.09 parts by mole to 0.02 parts by mole and that the reaction under reduced pressure at 208° C. for 6 hours is changed to a reaction at 208° C. for 3.1 hours. Furthermore, the polyester resin 8 is subjected to resin dispersion and centrifugation treatment under the same conditions as those in the preparation of the resin particle liquid dispersion 6 from the polyester resin 6, thereby obtaining a resin particle liquid dispersion 21.

(Preparation of Polyester Resin 9 and Resin Particle Liquid Dispersion 22)

A polyester resin 9 is obtained in the same manner as in the polyester resin 6, except that in the preparation of the polyester resin 6, the amount of dibutyltin oxide to be first added is changed from 0.09 parts by mole to 0.03 parts by mole and that the reaction under reduced pressure at 208° C. for 6 hours is changed to a reaction at 208° C. for 3.3 hours. Furthermore, the polyester resin 9 is subjected to resin dispersion and centrifugation treatment under the same conditions as those in the preparation of the resin particle liquid dispersion 6 from the polyester resin 6, thereby obtaining a resin particle liquid dispersion 22.

(Preparation of Polyester Resin 10 and Resin Particle Liquid Dispersion 23)

A polyester resin 10 is obtained in the same manner as in the polyester resin 6, except that in the preparation of the polyester resin 6, the amount of dibutyltin oxide to be first added is changed from 0.09 parts by mole to 0.04 parts by mole and that the reaction under reduced pressure at 208° C. for 6 hours is changed to a reaction at 208° C. for 3.4 hours. Furthermore, the polyester resin 10 is subjected to resin dispersion and centrifugation treatment under the same conditions as those in the preparation of the resin particle liquid dispersion 6 from the polyester resin 6, thereby obtaining a resin particle liquid dispersion 23.

(Preparation of Polyester Resin 11 and Resin Particle Liquid Dispersion 24)

A polyester resin 11 is obtained in the same manner as in the polyester resin 6, except that in the preparation of the polyester resin 6, the amount of dibutyltin oxide to be first added is changed from 0.09 parts by mole to 0.05 parts by mole and that the reaction under reduced pressure at 208° C. for 6 hours is changed to a reaction at 208° C. for 3.7 hours. Furthermore, the polyester resin 11 is subjected to resin dispersion and centrifugation treatment under the same conditions as those in the preparation of the resin particle liquid dispersion 6 from the polyester resin 6, thereby obtaining a resin particle liquid dispersion 24.

(Preparation of Polyester Resin 12 and Resin Particle Liquid Dispersion 25)

A polyester resin 12 is obtained in the same manner as in the polyester resin 6, except that in the preparation of the polyester resin 6, the amount of dibutyltin oxide to be first added is changed from 0.09 parts by mole to 0.11 parts by mole and that the reaction under reduced pressure at 208° C. for 6 hours is changed to a reaction at 208° C. for 3.9 hours. Furthermore, the polyester resin 12 is subjected to resin dispersion and centrifugation treatment under the same conditions as those in the preparation of the resin particle liquid dispersion 6 from the polyester resin 6, thereby obtaining a resin particle liquid dispersion 25.

(Preparation of Polyester Resin 13 and Resin Particle Liquid Dispersion 26)

A polyester resin 13 is obtained in the same manner as in the polyester resin 6, except that in the preparation of the polyester resin 6, the amount of dibutyltin oxide to be first added is changed from 0.09 parts by mole to 0.12 parts by mole and that the reaction under reduced pressure at 208° C. for 6 hours is changed to a reaction at 208° C. for 7.6 hours. Furthermore, the polyester resin 13 is subjected to resin dispersion and centrifugation treatment under the same conditions as those in the preparation of the resin particle liquid dispersion 6 from the polyester resin 6, thereby obtaining a resin particle liquid dispersion 26.

(Preparation of Polyester Resin 14 and Resin Particle Liquid Dispersion 27)

A polyester resin 14 is obtained in the same manner as in the polyester resin 6, except that in the preparation of the polyester resin 6, the amount of dibutyltin oxide to be first added is changed from 0.09 parts by mole to 0.14 parts by mole and that the reaction under reduced pressure at 208° C. for 6 hours is changed to a reaction at 208° C. for 7.8 hours. Furthermore, the polyester resin 14 is subjected to resin dispersion and centrifugation treatment under the same conditions as those in the preparation of the resin particle liquid dispersion 6 from the polyester resin 6, thereby obtaining a resin particle liquid dispersion 27.

(Preparation of Polyester Resin 15 and Resin Particle Liquid Dispersion 28)

A polyester resin 15 is obtained in the same manner as in the polyester resin 6, except that in the preparation of the polyester resin 6, the amount of dibutyltin oxide to be first added is changed from 0.09 parts by mole to 0.14 parts by mole and that the reaction under reduced pressure at 208° C. for 6 hours is changed to a reaction at 208° C. for 9.5 hours. Furthermore, the polyester resin 15 is subjected to resin dispersion and centrifugation treatment under the same conditions as those in the preparation of the resin particle liquid dispersion 6 from the polyester resin 6, thereby obtaining a resin particle liquid dispersion 28.

(Preparation of Polyester Resin 16 and Resin Particle Liquid Dispersion 29)

A polyester resin 16 is obtained in the same manner as in the polyester resin 6, except that in the preparation of the polyester resin 6, the amount of dibutyltin oxide to be first added is changed from 0.09 parts by mole to 0.14 parts by mole and that the reaction under reduced pressure at 208° C. for 6 hours is changed to a reaction at 208° C. for 10 hours. Furthermore, the polyester resin 16 is subjected to resin dispersion and centrifugation treatment under the same conditions as those in the preparation of the resin particle liquid dispersion 6 from the polyester resin 6, thereby obtaining a resin particle liquid dispersion 29.

(Preparation of Polyester Resin 17 and Resin Particle Liquid Dispersion 30)

A polyester resin 17 is obtained in the same manner as in the polyester resin 6, except that in the preparation of the polyester resin 6, the amount of dibutyltin oxide to be first added is changed from 0.09 parts by mole to 0.16 parts by mole and that the reaction under reduced pressure at 208° C. for 6 hours is changed to a reaction at 208° C. for 14 hours. Furthermore, the polyester resin 17 is subjected to resin dispersion and centrifugation treatment under the same conditions as those in the preparation of the resin particle liquid dispersion 6 from the polyester resin 6, thereby obtaining a resin particle liquid dispersion 30.

(Preparation of Polyester Resin 18 and Resin Particle Liquid Dispersion 31)

A polyester resin 18 is obtained in the same manner as in the polyester resin 6, except that in the preparation of the polyester resin 6, the amount of dibutyltin oxide to be first added is changed from 0.09 parts by mole to 0.17 parts by mole and that the reaction under reduced pressure at 208° C. for 6 hours is changed to a reaction at 208° C. for 15 hours. Furthermore, the polyester resin 18 is subjected to resin dispersion and centrifugation treatment under the same conditions as those in the preparation of the resin particle liquid dispersion 6 from the polyester resin 6, thereby obtaining a resin particle liquid dispersion 31.

(Preparation of Polyester Resin 19 and Resin Particle Liquid Dispersion 32)

| | |
|---|---|
| Dimethyl terephthalate: | 10 parts by mole |
| Dimethyl fumarate: | 80 parts by mole |
| n-Dodecenyl succinic acid: | 10 parts by mole |
| Bisphenol A ethylene oxide 2-mole adduct: | 48 parts by mole |
| Bisphenol A propylene oxide 2-mole adduct: | 52 parts by mole |
| Dibutyltin oxide: | 0.09 parts by mole |

A polyester resin 19 is obtained in the same manner as in the polyester resin 6, except for changing the composition of the first polymerizable monomers to the foregoing composition. Furthermore, the polyester resin 19 is subjected to resin dispersion and centrifugation treatment under the same conditions as those in the preparation of the resin particle liquid dispersion 6 from the polyester resin 6, thereby obtaining a resin particle liquid dispersion 32.

(Preparation of Polyester Resin 20 and Resin Particle Liquid Dispersion 33)

| | |
|---|---|
| Dimethyl terephthalate: | 10 parts by mole |
| Dimethyl fumarate: | 82 parts by mole |
| n-Dodecenyl succinic acid: | 8 parts by mole |
| Bisphenol A ethylene oxide 2-mole adduct: | 65 parts by mole |
| Bisphenol A propylene oxide 2-mole adduct: | 35 parts by mole |
| Dibutyltin oxide: | 0.09 parts by mole |

A polyester resin 20 is obtained in the same manner as in the polyester resin 6, except for changing the composition of the first polymerizable monomers to the foregoing composition. Furthermore, the polyester resin 20 is subjected to resin dispersion and centrifugation treatment under the same conditions as those in the preparation of the resin particle liquid dispersion 6 from the polyester resin 6, thereby obtaining a resin particle liquid dispersion 33.

(Preparation of Polyester Resin 21 and Resin Particle Liquid Dispersion 34)

| | |
|---|---|
| Dimethyl terephthalate: | 10 parts by mole |
| Dimethyl fumarate: | 84 parts by mole |
| n-Dodecenyl succinic acid: | 6 parts by mole |
| Bisphenol A ethylene oxide 2-mole adduct: | 70 parts by mole |
| Bisphenol A propylene oxide 2-mole adduct: | 30 parts by mole |
| Dibutyltin oxide: | 0.09 parts by mole |

A polyester resin 21 is obtained in the same manner as in the polyester resin 6, except for changing the composition of the first polymerizable monomers to the foregoing composition. Furthermore, the polyester resin 21 is subjected to resin dispersion and centrifugation treatment under the same conditions as those in the preparation of the resin particle liquid dispersion 6 from the polyester resin 6, thereby obtaining a resin particle liquid dispersion 34.

(Preparation of Polyester Resin 22 and Resin Particle Liquid Dispersion 35)

| | |
|---|---|
| Dimethyl terephthalate: | 10 parts by mole |
| Dimethyl fumarate: | 84 parts by mole |
| n-Dodecenyl succinic acid: | 6 parts by mole |
| Bisphenol A ethylene oxide 2-mole adduct: | 74 parts by mole |
| Bisphenol A propylene oxide 2-mole adduct: | 26 parts by mole |
| Dibutyltin oxide: | 0.09 parts by mole |

A polyester resin 22 is obtained in the same manner as in the polyester resin 6, except for changing the composition of the first polymerizable monomers to the foregoing composition. Furthermore, the polyester resin 22 is subjected to resin dispersion and centrifugation treatment under the same conditions as those in the preparation of the resin particle liquid dispersion 6 from the polyester resin 6, thereby obtaining a resin particle liquid dispersion 35.

(Preparation of Polyester Resin 23 and Resin Particle Liquid Dispersion 36)

| | |
|---|---|
| Dimethyl terephthalate: | 10 parts by mole |
| Dimethyl fumarate: | 84 parts by mole |
| n-Dodecenyl succinic acid: | 6 parts by mole |
| Bisphenol A ethylene oxide 2-mole adduct: | 78 parts by mole |
| Bisphenol A propylene oxide 2-mole adduct: | 22 parts by mole |
| Dibutyltin oxide: | 0.09 parts by mole |

A polyester resin 23 is obtained in the same manner as in the polyester resin 6, except for changing the composition of the first polymerizable monomers to the foregoing composition. Furthermore, the polyester resin 23 is subjected to resin dispersion and centrifugation treatment under the same conditions as those in the preparation of the resin particle liquid dispersion 6 from the polyester resin 6, thereby obtaining a resin particle liquid dispersion 36.

(Preparation of Polyester Resin 24 and Resin Particle Liquid Dispersion 37)

| | |
|---|---|
| Dimethyl terephthalate: | 10 parts by mole |
| Dimethyl fumarate: | 85 parts by mole |
| n-Dodecenyl succinic acid: | 5 parts by mole |
| Bisphenol A ethylene oxide 2-mole adduct: | 81 parts by mole |
| Bisphenol A propylene oxide 2-mole adduct: | 19 parts by mole |
| Dibutyltin oxide: | 0.09 parts by mole |

A polyester resin 24 is obtained in the same manner as in the polyester resin 6, except for changing the composition of the first polymerizable monomers to the foregoing composition. Furthermore, the polyester resin 24 is subjected to resin dispersion and centrifugation treatment under the same conditions as those in the preparation of the resin particle liquid dispersion 6 from the polyester resin 6, thereby obtaining a resin particle liquid dispersion 37.

(Preparation of Polyester Resin 25 and Resin Particle Liquid Dispersion 38)

| | |
|---|---|
| Dimethyl terephthalate: | 10 parts by mole |
| Dimethyl fumarate: | 85 parts by mole |
| n-Dodecenyl succinic acid: | 5 parts by mole |
| Bisphenol A ethylene oxide 2-mole adduct: | 87 parts by mole |
| Bisphenol A propylene oxide 2-mole adduct: | 13 parts by mole |
| Dibutyltin oxide: | 0.09 parts by mole |

A polyester resin 25 is obtained in the same manner as in the polyester resin 6, except for changing the composition of the first polymerizable monomers to the foregoing composition. Furthermore, the polyester resin 25 is subjected to resin dispersion and centrifugation treatment under the same conditions as those in the preparation of the resin particle liquid dispersion 6 from the polyester resin 6, thereby obtaining a resin particle liquid dispersion 38.

(Preparation of Polyester Resin 26 and Resin Particle Liquid Dispersion 39)

| | |
|---|---|
| Dimethyl terephthalate: | 10 parts by mole |
| Dimethyl fumarate: | 86 parts by mole |
| n-Dodecenyl succinic acid: | 4 parts by mole |
| Bisphenol A ethylene oxide 2-mole adduct: | 90 parts by mole |
| Bisphenol A propylene oxide 2-mole adduct: | 10 parts by mole |
| Dibutyltin oxide: | 0.09 parts by mole |

A polyester resin 26 is obtained in the same manner as in the polyester resin 6, except for changing the composition of the first polymerizable monomers to the foregoing composition. Furthermore, the polyester resin 26 is subjected to resin dispersion and centrifugation treatment under the same conditions as those in the preparation of the resin particle liquid dispersion 6 from the polyester resin 6, thereby obtaining a resin particle liquid dispersion 39.

(Preparation of Polyester Resin 27 and Resin Particle Liquid Dispersion 40)

| | |
|---|---|
| Dimethyl terephthalate: | 10 parts by mole |
| Dimethyl fumarate: | 87 parts by mole |
| n-Dodecenyl succinic acid: | 3 parts by mole |
| Bisphenol A ethylene oxide 2-mole adduct: | 93 parts by mole |
| Bisphenol A propylene oxide 2-mole adduct: | 7 parts by mole |
| Dibutyltin oxide: | 0.09 parts by mole |

A polyester resin 27 is obtained in the same manner as in the polyester resin 6, except for changing the composition of the first polymerizable monomers to the foregoing composition. Furthermore, the polyester resin 27 is subjected to resin dispersion and centrifugation treatment under the same conditions as those in the preparation of the resin particle liquid dispersion 6 from the polyester resin 6, thereby obtaining a resin particle liquid dispersion 40.

(Preparation of Polyester Resin 28 and Resin Particle Liquid Dispersion 41)

| | |
|---|---|
| Dimethyl terephthalate: | 10 parts by mole |
| Dimethyl fumarate: | 87 parts by mole |
| n-Dodecenyl succinic acid: | 3 parts by mole |
| Bisphenol A ethylene oxide 2-mole adduct: | 95 parts by mole |
| Bisphenol A propylene oxide 2-mole adduct: | 5 parts by mole |
| Dibutyltin oxide: | 0.09 parts by mole |

A polyester resin 28 is obtained in the same manner as in the polyester resin 6, except for changing the composition of the first polymerizable monomers to the foregoing composition. Furthermore, the polyester resin 28 is subjected to resin dispersion and centrifugation treatment under the same conditions as those in the preparation of the resin particle liquid dispersion 6 from the polyester resin 6, thereby obtaining a resin particle liquid dispersion 41.

(Preparation of Polyester Resin 29 and Resin Particle Liquid Dispersion 42)

| | |
|---|---|
| Dimethyl terephthalate: | 10 parts by mole |
| Dimethyl fumarate: | 87 parts by mole |
| n-Dodecenyl succinic acid: | 3 parts by mole |
| Bisphenol A ethylene oxide 2-mole adduct: | 98 parts by mole |
| Bisphenol A propylene oxide 2-mole adduct: | 2 parts by mole |
| Dibutyltin oxide: | 0.09 parts by mole |

A polyester resin 29 is obtained in the same manner as in the polyester resin 6, except for changing the composition of the first polymerizable monomers to the foregoing composition. Furthermore, the polyester resin 29 is subjected to resin dispersion and centrifugation treatment under the same conditions as those in the preparation of the resin particle liquid dispersion 6 from the polyester resin 6, thereby obtaining a resin particle liquid dispersion 42.

(Preparation of Polyester Resin 30 and Resin Particle Liquid Dispersion 43)

| | |
|---|---|
| Dimethyl terephthalate; | 10 parts by mole |
| Dimethyl fumarate: | 89 parts by mole |
| n-Dodecenyl succinic acid: | 1 part by mole |
| Bisphenol A ethylene oxide 2-mole adduct: | 100 parts by mole |
| Dibutyltin oxide: | 0.09 parts by mole |

A polyester resin 30 is obtained in the same manner as in the polyester resin 6, except for changing the composition of the first polymerizable monomers to the foregoing composition. Furthermore, the polyester resin 30 is subjected to resin dispersion and centrifugation treatment under the same conditions as those in the preparation of the resin particle liquid dispersion 6 from the polyester resin 6, thereby obtaining a resin particle liquid dispersion 43.

(Preparation of Polyester Resin 31 and Resin Particle Liquid Dispersion 44)

| | |
|---|---|
| Dimethyl terephthalate: | 10 parts by mole |
| Dimethyl fumarate: | 87 parts by mole |
| n-Dodecenyl succinic acid: | 3 parts by mole |
| Ethylene glycol: | 96 parts by mole |
| 1,4-Cyclohexanedimethanol: | 4 parts by mole |
| Dibutyltin oxide: | 0.09 parts by mole |

A polyester resin 31 is obtained in the same manner as in the polyester resin 6, except for changing the composition of the first polymerizable monomers to the foregoing composition. Furthermore, the polyester resin 31 is subjected to resin dispersion and centrifugation treatment under the same conditions as those in the preparation of the resin particle liquid dispersion 6 from the polyester resin 6, thereby obtaining a resin particle liquid dispersion 44.

(Preparation of Pigment Liquid Dispersion 1)

| | |
|---|---|
| C.I. Pigment Red 122 (Chromofine Magenta 6887, manufactured by Dainichiseika Color & Chemicals Mfg. Co., Ltd.): | 80 parts by weight |
| Anionic surfactant (Dowfax, manufactured by Dow Chemical Company): | 10 parts by weight |
| Ion exchanged water: | 245 parts by weight |

The foregoing components are mixed and dispersed for 20 minutes using a homogenizer (Ultra Turrax T50, manufactured by IKA), followed by application to a circulation type ultrasonic homogenizer (RUS-600TCVP, manufactured by Nissei Corporation) to prepare a pigment liquid dispersion 1 having a solids content of 24.7% by weight.

(Preparation of Pigment Liquid Dispersion 2)

A pigment liquid dispersion 2 is prepared in the same manner as that in the preparation of the pigment liquid dispersion 1, except for changing the pigment to carbon black (R330, manufactured by Cabot Corporation).

(Preparation of Pigment Liquid Dispersion 3)

A pigment liquid dispersion 3 is prepared in the same manner as that in the preparation of the pigment liquid dispersion 1, except for changing the pigment to C.I. Pigment Yellow 74 (Seikafast Yellow 2054, manufactured by Dainichiseika Color & Chemicals Mfg. Co., Ltd.).

(Preparation of Pigment Liquid Dispersion 4)

A pigment liquid dispersion 4 is prepared in the same manner as that in the preparation of the pigment liquid dispersion 1, except for changing the pigment to C.I. Pigment Blue 15:3 (Cyanine Blue 4937, which is a phthalocyanine based pigment, manufactured by Dainichiseika Color & Chemicals Mfg. Co., Ltd.).

(Preparation of Release Agent Liquid Dispersion)

| | |
|---|---|
| Release agent (FT105, manufactured by Nippon Seiro Co., Ltd.): | 90 parts by weight |
| Anionic surfactant (Dowfax, manufactured by Dow Chemical Company): | 15 parts by weight |
| Ion exchanged water: | 270 parts by weight |

The foregoing components are mixed and dispersed for 20 minutes using a homogenizer (Ultra Turrax T50, manufactured by IKA), followed by application to a circulation type ultrasonic homogenizer (RUS-600TCVP, manufactured by Nissei Corporation) to prepare a release agent liquid dispersion having a solids content of 25.2% by weight.

(Preparation of Toner Particle (1))

| | |
|---|---|
| Resin particle liquid dispersion 1: | 152.2 parts by weight |
| Pigment liquid dispersion 1: | 28.7 parts by weight |
| Release agent liquid dispersion: | 27.8 parts by weight |
| Surfactant (Dowfax, manufactured by Dow Chemical Company): | 6 parts by weight |
| Ion exchanged water: | 456 parts by weight |

The foregoing compounds are mixed and dispersed in a circular stainless steel-made flask by a homogenizer (Ultra Turrax T50, manufactured by IKA). Thereafter, 5 parts by weight of a 10% aluminum sulfate aqueous solution is added while keeping the foregoing liquid dispersion at 5° C. using a water bath, and the contents within the flask are stirred. The contents are confirmed to be thoroughly dispersed and then stirred at a stirring rotation number of 150 rpm for 34 hours using a three-one motor (BLh300, manufactured by Shinto Scientific Co., Ltd.). Thereafter, the resultant is heated to 44° C. at a temperature rise rate of 0.1° C./min with stirring and kept at 44° C. for 35 minutes. At that time, the liquid dispersion has a pH of 2.5. Thereafter, 65.2 parts by weight of the additional resin particle liquid dispersion 1 having been previously adjusted at a pH of 4.3 is added, and the mixture is stirred for 40 minutes. The obtained contents are observed by an optical microscope. As a result, it is confirmed that aggregated particles having a particle diameter of about 6.0 μm are produced. 14 parts by weight of a 0.8 M sodium hydroxide aqueous solution is added. Thereafter, the temperature is raised, and at a point of time when the temperature reaches 90° C., 12 parts by weight of a 22% EDTA aqueous solution is added. Thereafter, the mixture is allowed to stand for 5 hours and then cooled. After cooling, the resulting mixture is filtered, followed by (1) dispersing in 300 parts by weight of ion exchanged water, (2) stirring at 100 rpm for 20 hours and (3) filtration. The operations (1) to (3) are repeated 6 times, followed by drying at 40° C., at about 10 Pa and for 12 hours to obtain a toner particle (1) having a volume average particle diameter of 6.2 μm.

(Preparation of Toner (1))

Commercially available fumed silica RX50 (manufactured by Nippon Aerosil Co., Ltd., number average particle diameter D50: 40 nm) is prepared. To 100 parts by weight of the obtained toner particle (1), 2 parts by weight of fumed silica RX50 (manufactured by Nippon Aerosil Co., Ltd., number average particle diameter D50: 40 nm) are added as an external additive, the mixture is blended at a peripheral speed of 30 m/s for 5 minutes using a Henschel mixer, and thereafter, coarse particles are removed using a 45 μm-mesh sieve, thereby obtaining a toner (1).

(Measurement of Physical Properties)

The number of non-colored particles not containing a coloring agent in the toner is measured in the foregoing method. As a result, the non-colored particles not containing a coloring agent are confirmed to exist in the number of 12 per 5,000 toner particles.

A value obtained by dividing the amount of Sn element of the non-colored particles by the amount of Sn element of the toner particles is 1.2, and the amount of Sn element contained in the non-colored particles is larger than the amount of Sn element contained in the toner particle.

A weight average molecular weight of the non-colored particles is 12,500, and a glass transition temperature is 60° C.

(Preparation of Toner Particles (2) to (47) and Toners (2) to (47))

Toner particles (2) to (47) are prepared in the same manner as in the toner particle (1), except for changing the resin particle liquid dispersion and the pigment liquid dispersion as shown in Table 1; and toners (2) to (47) are prepared by following the same external addition operation as in the preparation of the toner (1), except for changing the toner particle (1) to the toner particles (2) to (47), respectively.

(Preparation of Toner Particle (48) and Toner (48))

A resin particle liquid dispersion 45 is prepared by following the same operation as in the resin particle liquid dispersion 1, except that in the preparation of the resin particle liquid dispersion 1, the centrifugation treatment is not carried out; a toner particle (48) is prepared in the same manner as in the toner particle (1), except for changing the resin particle liquid dispersion 1 to the resin particle liquid dispersion 45; and a toner (48) is prepared by following the same external addition operation as in the preparation of the toner (1).

(Preparation of Carrier)

1,000 parts by weight of Mn—Mg ferrite (volume average particle diameter: 50 μm, manufactured by Powdertech Co., Ltd.) is thrown into a kneader; a solution of 150 parts by weight of a styrene/methyl methacrylate/acrylic acid copolymer (polymerization ratio: 39/60/1 (by mole), Tg: 100° C., weight average molecular weight: 80,000, manufactured by Soken Chemical & Engineering Co., Ltd.) dissolved in 700 parts by weight is added and mixed at ordinary temperature for 20 minutes; and the mixture is then heated to 70° C. and dried under reduced pressure, followed by taking out to obtain a coated carrier. Furthermore, the obtained coated carrier is screened with a 75 μm-mesh sieve to remove a coarse powder, thereby obtaining a carrier.

(Preparation of Developer)

A V blender is charged with the carrier and each of the toners (1) to (48) in a proportion of 95/5 in terms of a weight ratio, and the mixture is stirred for 20 minutes, thereby obtaining developers (1) to (48).

Examples 1 to 47 and Comparative Example 1

By using the foregoing developers (1) to (48) and toners (1) to (48), the following image quality evaluation is carried out.

The value obtained by dividing the amount of Sn element of the non-colored particles by the amount of Sn element of the toner particles, the number of non-colored particles in 5,000 toner particles, the weight average molecular weight (Mw), the glass transition temperature (Tg) and the evaluation result are shown in Table 1

(Image Quality Evaluation)

The toner cartridge is stored under a storage condition (the temperature is increased at a rate of 1° C./min between 40° C. and 55° C. in a stored state in the toner cartridge, the toner cartridge is allowed to stand at 55° C. for 30 minutes, and the temperature is then decreased to 40° C. at a rate of 1° C./min; and this temperature increase and decrease operation is repeated 10 times, namely for 10 hours). Thereafter, the toner cartridge is installed in a modified machine of DocuCenter-Color 400 (manufactured by Fuji Xerox Co., Ltd., in which the gap between the developer holding member and the layer thickness regulating member can be adjusted, and the developer is able to output even one color), and the gap between the developer holding member and the layer thickness regulating member is adjusted at 300 μm, 90 μm, 100 μm, 200 μm, 400 μm, 500 μm and 510 μm, respectively. An image (Test Charts No. 1-R 1993 of the Imaging Society of Japan) is outputted onto 20,000 sheets of papers (C2r Paper, manufactured by Fuji Xerox Co., Ltd.), and a level of the generation of color streaks is visually evaluated for every 1,000 sheets. The evaluation criteria are as flows. The results are shown in Table 2. A tolerable range is up to Grade 2.

Grade 7: The generation of color streaks cannot be confirmed even at 20,000 sheets.

Grade 6: The generation of not more than two color streaks can be confirmed at 20,000 sheets.

Grade 5: The generation of not more than two color streaks can be confirmed at 19,000 sheets.

Grade 4: The generation of not more than two color streaks can be confirmed at 18,000 sheets.

Grade 3: The generation of not more than two color streaks can be confirmed at 16,000 sheets.

Grade 2: The generation of not more than two color streaks can be confirmed at 14,000 sheets.

Grade 1: The generation of three or more color streaks can be confirmed at 14,000 sheets.

TABLE 1

| | Polyester | Resin particle liquid dispersion | Pigment liquid dispersion |
|---|---|---|---|
| Toner particle (1) | 1 | 1 | 1 |
| Toner particle (2) | 2 | 2 | 1 |
| Toner particle (3) | 3 | 3 | 1 |
| Toner particle (4) | 4 | 4 | 1 |
| Toner particle (5) | 5 | 5 | 1 |
| Toner particle (6) | 6 | 6 | 1 |
| Toner particle (7) | 1 | 7 | 1 |
| Toner particle (8) | 2 | 8 | 1 |
| Toner particle (9) | 3 | 9 | 1 |
| Toner particle (10) | 1 | 10 | 1 |
| Toner particle (11) | 2 | 11 | 1 |
| Toner particle (12) | 1 | 12 | 1 |
| Toner particle (13) | 4 | 13 | 1 |
| Toner particle (14) | 5 | 14 | 1 |
| Toner particle (15) | 1 | 15 | 1 |
| Toner particle (16) | 4 | 16 | 1 |
| Toner particle (17) | 1 | 17 | 1 |
| Toner particle (18) | 2 | 18 | 1 |
| Toner particle (19) | 4 | 19 | 1 |
| Toner particle (20) | 7 | 20 | 1 |
| Toner particle (21) | 8 | 21 | 1 |
| Toner particle (22) | 9 | 22 | 1 |
| Toner particle (23) | 10 | 23 | 1 |

TABLE 1-continued

| | Polyester | Resin particle liquid dispersion | Pigment liquid dispersion |
|---|---|---|---|
| Toner particle (24) | 11 | 24 | 1 |
| Toner particle (25) | 12 | 25 | 1 |
| Toner particle (26) | 13 | 26 | 1 |
| Toner particle (27) | 14 | 27 | 1 |
| Toner particle (28) | 15 | 28 | 1 |
| Toner particle (29) | 16 | 29 | 1 |
| Toner particle (30) | 17 | 30 | 1 |
| Toner particle (31) | 18 | 31 | 1 |
| Toner particle (32) | 19 | 32 | 1 |
| Toner particle (33) | 20 | 33 | 1 |
| Toner particle (34) | 21 | 34 | 1 |
| Toner particle (35) | 22 | 35 | 1 |
| Toner particle (36) | 23 | 36 | 1 |

TABLE 1-continued

| | Polyester | Resin particle liquid dispersion | Pigment liquid dispersion |
|---|---|---|---|
| Toner particle (37) | 24 | 37 | 1 |
| Toner particle (38) | 25 | 38 | 1 |
| Toner particle (39) | 26 | 39 | 1 |
| Toner particle (40) | 27 | 40 | 1 |
| Toner particle (41) | 28 | 41 | 1 |
| Toner particle (42) | 29 | 42 | 1 |
| Toner particle (43) | 30 | 43 | 1 |
| Toner particle (44) | 31 | 44 | 1 |
| Toner particle (45) | 6 | 6 | 2 |
| Toner particle (46) | 6 | 6 | 3 |
| Toner particle (47) | 6 | 6 | 4 |
| Toner particle (48) | 1 | 45 | 1 |

TABLE 2

| | Toner | Ratio of amount of Sn element | Number | Mw | Tg [° C.] |
|---|---|---|---|---|---|
| Example 1 | Toner (1) | 1.2 | 12 | 12500 | 60 |
| Example 2 | Toner (2) | 2.8 | 12 | 16100 | 63 |
| Example 3 | Toner (3) | 3.2 | 12 | 17000 | 63 |
| Example 4 | Toner (4) | 3.9 | 11 | 18600 | 64 |
| Example 5 | Toner (5) | 4.3 | 12 | 19500 | 65 |
| Example 6 | Toner (6) | 2.1 | 21 | 14500 | 62 |
| Example 7 | Toner (7) | 1.2 | 28 | 12500 | 60 |
| Example 8 | Toner (8) | 2.7 | 27 | 15900 | 62 |
| Example 9 | Toner (9) | 3.1 | 27 | 16800 | 63 |
| Example 10 | Toner (10) | 1.1 | 32 | 12200 | 60 |
| Example 11 | Toner (11) | 2.9 | 33 | 16300 | 63 |
| Example 12 | Toner (12) | 1.3 | 47 | 12700 | 60 |
| Example 13 | Toner (13) | 3.8 | 48 | 18500 | 64 |
| Example 14 | Toner (14) | 4.2 | 46 | 19300 | 65 |
| Example 15 | Toner (15) | 1.2 | 52 | 12500 | 60 |
| Example 16 | Toner (16) | 3.7 | 55 | 18200 | 64 |
| Example 17 | Toner (17) | 1.2 | 6 | 12500 | 60 |
| Example 18 | Toner (18) | 2.9 | 7 | 16300 | 63 |
| Example 19 | Toner (19) | 3.8 | 7 | 18400 | 64 |
| Example 20 | Toner (20) | 1.9 | 20 | 4800 | 61 |
| Example 21 | Toner (21) | 1.9 | 23 | 5200 | 61 |
| Example 22 | Toner (22) | 1.9 | 25 | 6900 | 61 |
| Example 23 | Toner (23) | 1.9 | 22 | 7200 | 61 |

| | Gap between developer holding member and layer thickness regulating member | | | | | | |
|---|---|---|---|---|---|---|---|
| | 300 μm Grade | 90 μm Grade | 100 μm Grade | 200 μm Grade | 400 μm Grade | 500 μm Grade | 510 μm Grade |
| Example 1 | 7 | 5 | 6 | 7 | 7 | 6 | 5 |
| Example 2 | 7 | 5 | 6 | 7 | 7 | 6 | 5 |
| Example 3 | 3 | 3 | 3 | 3 | 3 | 3 | 3 |
| Example 4 | 3 | 3 | 3 | 3 | 3 | 3 | 3 |
| Example 5 | 2 | 2 | 2 | 2 | 2 | 2 | 2 |
| Example 6 | 7 | 5 | 6 | 7 | 7 | 6 | 5 |
| Example 7 | 7 | 5 | 6 | 7 | 7 | 6 | 5 |
| Example 8 | 7 | 5 | 6 | 7 | 7 | 6 | 5 |
| Example 9 | 3 | 3 | 3 | 3 | 3 | 3 | 3 |
| Example 10 | 3 | 3 | 3 | 3 | 3 | 3 | 3 |
| Example 11 | 3 | 3 | 3 | 3 | 3 | 3 | 3 |
| Example 12 | 3 | 3 | 3 | 3 | 3 | 3 | 3 |
| Example 13 | 3 | 3 | 3 | 3 | 3 | 3 | 3 |
| Example 14 | 2 | 2 | 2 | 2 | 2 | 2 | 2 |
| Example 15 | 2 | 2 | 2 | 2 | 2 | 2 | 2 |
| Example 16 | 2 | 2 | 2 | 2 | 2 | 2 | 2 |
| Example 17 | 3 | 3 | 3 | 3 | 3 | 3 | 3 |
| Example 18 | 3 | 3 | 3 | 3 | 3 | 3 | 3 |
| Example 19 | 2 | 2 | 2 | 2 | 2 | 2 | 2 |
| Example 20 | 4 | 3 | 4 | 4 | 4 | 4 | 3 |
| Example 21 | 5 | 4 | 4 | 5 | 5 | 4 | 4 |
| Example 22 | 5 | 4 | 4 | 5 | 5 | 4 | 4 |
| Example 23 | 6 | 4 | 5 | 6 | 6 | 5 | 4 |

TABLE 2-continued

| | Toner | Ratio of amount of Sn element | Number | Mw | Tg [° C.] |
|---|---|---|---|---|---|
| Example 24 | Toner (24) | 2.0 | 24 | 9800 | 61 |
| Example 25 | Toner (25) | 2.0 | 22 | 10800 | 61 |
| Example 26 | Toner (26) | 2.2 | 20 | 24700 | 62 |
| Example 27 | Toner (27) | 2.2 | 21 | 25200 | 62 |
| Example 28 | Toner (28) | 2.3 | 21 | 29700 | 62 |
| Example 29 | Toner (29) | 2.3 | 23 | 31000 | 62 |
| Example 30 | Toner (30) | 2.4 | 24 | 39600 | 62 |
| Example 31 | Toner (31) | 2.4 | 21 | 40700 | 62 |
| Example 32 | Toner (32) | 2.0 | 23 | 14600 | 48 |
| Example 33 | Toner (33) | 2.1 | 25 | 15000 | 51 |
| Example 34 | Toner (34) | 2.0 | 18 | 14400 | 53 |
| Example 35 | Toner (35) | 2.1 | 22 | 14800 | 55 |
| Example 36 | Toner (36) | 2.1 | 20 | 15100 | 57 |
| Example 37 | Toner (37) | 2.1 | 25 | 16000 | 59 |
| Example 38 | Toner (38) | 2.0 | 26 | 14600 | 64 |
| Example 39 | Toner (39) | 2.1 | 19 | 15500 | 66 |
| Example 40 | Toner (40) | 2.1 | 23 | 17100 | 69 |
| Example 41 | Toner (41) | 2.1 | 22 | 16600 | 71 |
| Example 42 | Toner (42) | 2.0 | 25 | 12600 | 74 |
| Example 43 | Toner (43) | 2.0 | 21 | 13800 | 76 |
| Example 44 | Toner (44) | 2.1 | 21 | 14500 | 62 |
| Example 45 | Toner (45) | 2.1 | 21 | 14500 | 62 |
| Example 46 | Toner (46) | 2.2 | 18 | 14500 | 62 |
| Example 47 | Toner (47) | 2.1 | 22 | 14500 | 62 |
| Comparative Example 1 | Toner (48) | 1 | 21 | 14500 | 60 |

| | Gap between developer holding member and layer thickness regulating member | | | | | | |
|---|---|---|---|---|---|---|---|
| | 300 μm Grade | 90 μm Grade | 100 μm Grade | 200 μm Grade | 400 μm Grade | 500 μm Grade | 510 μm Grade |
| Example 24 | 6 | 4 | 5 | 6 | 6 | 5 | 4 |
| Example 25 | 7 | 5 | 6 | 7 | 7 | 6 | 5 |
| Example 26 | 7 | 5 | 6 | 7 | 7 | 6 | 5 |
| Example 27 | 6 | 4 | 5 | 6 | 6 | 5 | 4 |
| Example 28 | 6 | 4 | 5 | 6 | 6 | 5 | 4 |
| Example 29 | 5 | 4 | 4 | 5 | 5 | 4 | 4 |
| Example 30 | 5 | 4 | 4 | 5 | 5 | 4 | 4 |
| Example 31 | 4 | 3 | 4 | 4 | 4 | 4 | 3 |
| Example 32 | 4 | 3 | 4 | 4 | 4 | 4 | 3 |
| Example 33 | 5 | 4 | 4 | 5 | 5 | 4 | 4 |
| Example 34 | 5 | 4 | 4 | 5 | 5 | 4 | 4 |
| Example 35 | 6 | 4 | 5 | 6 | 6 | 5 | 4 |
| Example 36 | 6 | 4 | 5 | 6 | 6 | 5 | 4 |
| Example 37 | 7 | 5 | 6 | 7 | 7 | 6 | 5 |
| Example 38 | 7 | 5 | 6 | 7 | 7 | 6 | 5 |
| Example 39 | 6 | 4 | 5 | 6 | 6 | 5 | 4 |
| Example 40 | 6 | 4 | 5 | 6 | 6 | 5 | 4 |
| Example 41 | 5 | 4 | 4 | 5 | 5 | 4 | 4 |
| Example 42 | 5 | 4 | 4 | 5 | 5 | 4 | 4 |
| Example 43 | 4 | 3 | 4 | 4 | 4 | 4 | 3 |
| Example 44 | 6 | 4 | 5 | 6 | 6 | 5 | 4 |
| Example 45 | 7 | 5 | 6 | 7 | 7 | 6 | 5 |
| Example 46 | 7 | 5 | 6 | 7 | 7 | 6 | 5 |
| Example 47 | 7 | 5 | 6 | 7 | 7 | 6 | 5 |
| Comparative Example 1 | 1 | 1 | 1 | 1 | 1 | 1 | 1 |

As is clear from Table 2, as compared with the toner of Comparative Example 1, in the toners of Examples 1 to 47, the generation of an image quality defect of color streaks is suppressed even after the storage under a specified heat condition, and the image quality is favorable. Also, when the gap between the developer image holding member and the layer thickness regulating member is appropriate, there is a tendency that the generation of an image quality of color streaks is suppressed.

While the present invention has been shown and described with reference to certain exemplary embodiments thereof, it will be understood by those skilled in the art that various changes modifications may be made therein without departing from the spirit and scope of the present invention as defined by the appended claims.

What is claimed is:

1. An electrostatic image developing toner comprising:

a toner particle containing a binder resin having a polyester resin and a coloring agent; and a non-colored particle containing a polyester but not containing a coloring agent and having a shape factor SF1 of not more than 110, wherein an amount of Sn element contained in the non-colored particle is from 1.1 times to 4 times larger than an amount of Sn element contained in the toner particle.

2. The electrostatic image developing toner according to claim 1, wherein the number of the non-colored particle is in the range of from 10 to 50 based on 5,000 toner particles.

3. The electrostatic image developing toner according to claim 1, wherein a weight average molecular weight of the non-colored particle is in the range of from 5,000 to 40,000.

4. The electrostatic image developing toner according to claim 1, wherein a glass transition temperature of the non-colored particle is in the range of from 50° C. to 75° C.

5. The electrostatic image developing toner according to claim 1, wherein the polyester resin contains bisphenol A as a constituent component.

6. The electrostatic image developing toner according to claim 1, wherein a volume average particle diameter of the toner particle is in the range of from 4 μm to 8 μm.

7. The electrostatic image developing toner according to claim 1, wherein a volume average particle size distribution index $GSD_v$ of the toner particle is not more than 1.27.

8. The electrostatic image developing toner according to claim 1, wherein a shape factor SF1 of the toner particle is in the range of from 110 to 140.

9. The electrostatic image developing toner according to claim 1, wherein the toner particle further comprises a release agent, and a content of the release agent is in the range of from 1 part by weight to 10 parts by weight based on 100 parts by weight of the binder resin.

10. The electrostatic image developing toner according to claim 1, wherein a content of the coloring agent is in the range of from 0.1 part by weight to 40 parts by weight based on 100 parts by weight of the binder resin.

11. An electrostatic image developer comprising:

a carrier; and the electrostatic image developing toner according to claim 1.

12. The electrostatic image developer according to claim 11, wherein a volume average particle diameter of the carrier is in the range of from 30 μm to 200 μm.

13. The electrostatic image developer according to claim 11, wherein the carrier is a resin-coated carrier including a nucleus particle of the carrier and a coating resin, the nucleus particle of the carrier is coated over the coating resin, and a coating amount of the coating resin is in the range of from 0.1 part by weight to 10 parts by weight.

14. An image forming method comprising:

charging the surface of an image holding member;

forming an electrostatic latent image on a surface of the image holding member;

developing the electrostatic latent image to form a developed image by using a developing unit including:

a developer holding member for holding a developer; and a layer thickness regulating member for regulating a layer thickness of the developer on the surface of the developer holding member, with a gap between the developer holding member and the layer thickness regulating member being in the range of from 100 μm to 500 μm; and transferring the developed image onto a transfer-receiving member, wherein the developer is the electrostatic image developer according to claim 11.

* * * * *